US011721897B2

(12) United States Patent
Udagave

(10) Patent No.: US 11,721,897 B2
(45) Date of Patent: Aug. 8, 2023

(54) REMOTE ELECTRONIC TILT ACTUATORS FOR CONTROLLING MULTIPLE PHASE SHIFTERS AND BASE STATION ANTENNAS WITH REMOTE ELECTRONIC TILT ACTUATORS

(71) Applicant: CommScope Technologies LLC, Hickory, NC (US)

(72) Inventor: Shital Sawanta Udagave, Maharashtra (IN)

(73) Assignee: CommScope Technologies LLC, Hickory, NC (US)

( * ) Notice: Subject to any disclaimer, the term of this patent is extended or adjusted under 35 U.S.C. 154(b) by 4 days.

(21) Appl. No.: 17/766,624

(22) PCT Filed: Nov. 11, 2020

(86) PCT No.: PCT/US2020/059921
§ 371 (c)(1),
(2) Date: Apr. 5, 2022

(87) PCT Pub. No.: WO2021/118738
PCT Pub. Date: Jun. 17, 2021

(65) Prior Publication Data

US 2023/0139300 A1 May 4, 2023

Related U.S. Application Data

(60) Provisional application No. 62/947,595, filed on Dec. 13, 2019.

(51) Int. Cl.

| | |
|---|---|
| ***H01Q 3/32*** | (2006.01) |
| ***H01P 1/18*** | (2006.01) |
| ***H01Q 1/24*** | (2006.01) |

(52) U.S. Cl.
CPC ..... *H01Q 3/32* (2013.01); *H01P 1/18* (2013.01); *H01Q 1/246* (2013.01)

(58) Field of Classification Search
CPC ..... H01Q 3/32; H01Q 1/24; H01P 1/18
See application file for complete search history.

(56) References Cited

U.S. PATENT DOCUMENTS

| | | | |
|---|---|---|---|
| 7,907,096 | B2 | 3/2011 | Timofeev et al. |
| 8,217,848 | B2 | 7/2012 | Girard et al. |

(Continued)

FOREIGN PATENT DOCUMENTS

| | | | |
|---|---|---|---|
| CN | 209730178 | U | 12/2019 |
| KR | 101600832 | B1 | 3/2016 |

(Continued)

OTHER PUBLICATIONS

"International Search Report and Written Opinion of the International Searching Authority", International Application No. PCT/US2020/059921, dated Mar. 3, 2021, 10 pp.

(Continued)

*Primary Examiner* — Andrea Lindgren Baltzell
(74) *Attorney, Agent, or Firm* — Myers Bigel, P.A.

(57) ABSTRACT

Base station antennas include a RET actuator, a plurality of phase shifters and a plurality of mechanical linkages, where each mechanical linkage is connected between the RET actuator and a respective one or more of the phase shifters. The RET actuator includes a rotary drive element movable in a first rotary direction and a second rotary direction. A first drive system is connected between the rotary drive element and the first mechanical linkage. The first drive system moves the first mechanical linkage in a first linear direction and a second linear direction when the rotary drive element is moved in the first rotary direction. A second drive system connected between the rotary drive element and the second (Continued)

mechanical linkage. The second drive system moves the second mechanical linkage in a third linear direction and a fourth linear direction when the rotary drive element is moved in the second rotary direction.

28 Claims, 12 Drawing Sheets

(56) References Cited

U.S. PATENT DOCUMENTS

| | | | | |
|---|---|---|---|---|
| 9,343,811 | B2 | 5/2016 | Xie et al. | |
| 10,320,076 | B2 * | 6/2019 | Fang | F16H 1/32 |
| 10,490,894 | B2 * | 11/2019 | Kim | H01Q 1/125 |
| 10,734,712 | B2 | 8/2020 | Duan et al. | |
| 2006/0066494 | A1 | 3/2006 | Trejtnar et al. | |
| 2013/0307728 | A1 | 11/2013 | Berger et al. | |
| 2017/0365923 | A1 | 12/2017 | Schmutzler et al. | |
| 2018/0287255 | A1 | 10/2018 | Zimmerman | |
| 2020/0373663 | A1 | 11/2020 | Xu | |

FOREIGN PATENT DOCUMENTS

| | | | |
|---|---|---|---|
| KR | 101804955 | B1 | 12/2017 |
| WO | 2017196811 | A1 | 11/2017 |

OTHER PUBLICATIONS

"International Search Report and Written Opinion of the International Searching Authority", International Application No. PCT/US2020/059926, dated Mar. 8, 2021, 11 pp.

* cited by examiner

REMOTE ELECTRONIC TILT ACTUATORS FOR CONTROLLING MULTIPLE PHASE SHIFTERS AND BASE STATION ANTENNAS WITH REMOTE ELECTRONIC TILT ACTUATORS

CROSS-REFERENCE TO RELATED APPLICATIONS

The present application is a 35 U.S.C. § 371 national stage application of PCT Application No. PCT/US2020/059921, filed on Nov. 11, 2020, which itself claims priority from and the benefit of U.S. Provisional Patent Application No. 62/947,595, filed Dec. 13, 2019, the entire contents of both of which are incorporated herein by reference in their entireties. The above-referenced PCT Application was published in the English language as International Publication No. WO 2021/118738 A1 on Jun. 17, 2021.

FIELD OF THE INVENTION

The present invention relates to communication systems and, in particular, to base station antennas having remote electronic tilt capabilities.

BACKGROUND

Cellular communications systems are used to provide wireless communications to fixed and mobile subscribers (herein "users"). A cellular communications system may include a plurality of base stations that each provide wireless cellular service for a specified coverage area that is typically referred to as a "cell." Each base station may include one or more base station antennas that are used to transmit radio frequency ("RF") signals to, and receive RF signals from, the users that are within the cell served by the base station. Base station antennas are directional devices that can concentrate the RF energy that is transmitted in certain directions (or received from those directions). The "gain" of a base station antenna in a given direction is a measure of the ability of the antenna to concentrate the RF energy in that particular direction. The "radiation pattern" of a base station antenna is compilation of the gain of the antenna across all different directions. The radiation pattern of a base station antenna is typically designed to service a pre-defined coverage area such as the cell or a portion thereof that is typically referred to as a "sector." The base station antenna may be designed to have minimum gain levels throughout its pre-defined coverage area, and it is typically desirable that the base station antenna have much lower gain levels outside of the coverage area to reduce interference between sectors/cells. Early base station antennas typically had a fixed radiation pattern, meaning that once a base station antenna was installed, its radiation pattern could not be changed unless a technician physically reconfigured the antenna. Unfortunately, such manual reconfiguration of base station antennas after deployment, which could become necessary due to changed environmental conditions or the installation of additional base stations, was typically difficult, expensive and time-consuming.

More recently, base station antennas have been deployed that have radiation patterns that can be reconfigured from a remote location by transmitting control signals to the antenna. Base station antennas having such capabilities are typically referred to as remote electronic tilt ("RET") antennas. The most common changes to the radiation pattern are changes in the down tilt angle (i.e., the elevation angle) and/or the azimuth angle. RET antennas allow wireless network operators to remotely adjust the radiation pattern of the antenna by transmitting control signals to the antenna that electronically alter the RF signals that are transmitted and received by the antenna.

Base station antennas typically comprise a linear array or a two-dimensional array of radiating elements such as patch, dipole or crossed dipole radiating elements. In order to electronically change the down tilt angle of these antennas, a phase taper may be applied across the radiating elements of the array, as is well understood by those of skill in the art. Such a phase taper may be applied by adjusting the settings on an adjustable phase shifter that is positioned along the RF transmission path between a radio and the individual radiating elements of the base station antenna. One widely-used type of phase shifter is an electromechanical "wiper" phase shifter that includes a main printed circuit board and a "wiper" printed circuit board that may be rotated above the main printed circuit board. Such wiper phase shifters typically divide an input RF signal that is received at the main printed circuit board into a plurality of sub-components, and then capacitively couple at least some of these sub-components to the wiper printed circuit board. The sub-components of the RF signal may be capacitively coupled from the wiper printed circuit board back to the main printed circuit board along a plurality of arc-shaped traces, where each arc has a different diameter. Each end of each arc-shaped trace may be connected to a radiating element or to a sub-group of radiating elements. By physically (mechanically) rotating the wiper printed circuit board above the main printed circuit board, the locations where the sub-components of the RF signal capacitively couple back to the main printed circuit board may be changed, which thus changes the length of the respective transmission path from the phase shifter to an associated radiating element for each sub-component of the RF signal. The changes in these path lengths result in changes in the phases of the respective sub-components of the RF signal, and since the arcs have different radii, the phase changes along the different paths will be different. Thus, the above-described wiper phase shifters may be used to apply a phase taper to the sub-components of an RF signal that are applied to each radiating element (or sub-group of radiating elements). Exemplary phase shifters of this variety are discussed in U.S. Pat. No. 7,907,096 to Timofeev, the disclosure of which is hereby incorporated by reference herein in its entirety. The wiper printed circuit board is typically moved using an electromechanical actuator such as a DC motor that is connected to the wiper printed circuit board via a mechanical linkage. These actuators are often referred to as RET actuators since they are used to apply the remote electronic down tilt.

SUMMARY OF THE INVENTION

In some embodiments, a base station antenna comprises a remote electronic tilt ("RET") actuator. A first mechanical linkage is connected between the RET actuator and a first phase shifter, and a second mechanical linkage is connected between the RET actuator and a second phase shifter. The RET actuator comprises a rotary drive element movable in a first rotary direction and a second rotary direction. A first drive system is connected between the rotary drive element and the first mechanical linkage where the first drive system moves the first mechanical linkage in a first linear direction and a second linear direction when the rotary drive element is moved in the first rotary direction. A second drive system is connected between the rotary drive element and the second mechanical linkage where the second drive system moves the second mechanical linkage in a third linear direction and a fourth linear direction when the rotary drive element is moved in the second rotary direction.

The rotary drive element may comprise a motor having a rotary output. A first one-way clutch may selectively connect the rotary drive element to the first drive system and a second one-way clutch may selectively connect the rotary drive element to the second drive system. The first one-way clutch and the second one-way clutch may each comprise a cam gear supporting a pivoting pawl where the cam gear is operably coupled to the rotary drive element; and a ratchet wheel having a plurality of teeth operably coupled to a clutch output where the pawl engages the teeth such that rotation of cam gear in a first direction causes the ratchet wheel to rotate with the cam gear and rotation of cam gear in a second direction allows the ratchet wheel to rotate independently of the cam gear. A first worm gear may be mounted for rotation with a clutch output of the first one-way clutch for transmitting rotation of the clutch output of the first one-way clutch to the first drive system and a second worm gear may be mounted for rotation with a clutch output of the second one-way clutch for transmitting rotation of the clutch output of the second one-way clutch to the second drive system. The first drive system may comprise a belt. The belt may be wound over a first pulley and a second pulley. The first pulley and the second pulley may include teeth that engage teeth on the belt. The belt may include a first run and a second run between the first pulley and the second pulley. The first run may move in an extension direction and the second run may move in a retraction direction. The first run and the second run may be selectively operably coupled to the first mechanical linkage by a first linkage system. The first linkage system may comprise a first stopper plate and a second stopper plate where the distance between the first stopper plate and the second stopper plate sets the maximum distance of travel of the first mechanical linkage. The first stopper plate may be positioned adjacent the first pulley and the second stopper plate may be positioned adjacent the second pulley. The first stopper plate may comprise a first curved track and the second stopper plate may comprise a second curved track where the first curved track faces the second curved track. At least one of the first stopper plate and the second stopper plate may comprise a longitudinally extending track. A drive rod may be mounted for reciprocating movement where the drive rod may be operatively coupled to the first mechanical linkage. The drive rod may be mounted for slidable movement in the longitudinally extending track. The drive rod may have a generally T-shape with the longitudinal leg of the drive rod supported in the longitudinally extending track. The drive rod may comprise a first arm and a second arm where the first arm extends over the first run and the second arm extends over the second run. A belt connector may releasably connect the drive rod to the first run of the belt and to the second run of the belt. The first arm may include a first engagement structure positioned to engage a belt connector that is mounted on and carried by the belt, and the second arm may include a second engagement structure positioned to engage the belt connector. The first engagement structure may comprise a first aperture positioned to receive a pin on the belt connector and the second engagement structure may comprise a second aperture positioned to receive the pin. The belt connector may be biased toward the drive rod. A first camming plate may be positioned at the leading edge of the first stopper plate and a second camming plate may be positioned at the leading edge of the second stopper plate. The first camming plate and the second camming plate may drive the belt connector away from the drive rod. The first camming plate may disengage the first engagement structure from the connector and the second camming plate may disengage the second engagement structure from the connector. A linkage connector may be rotatably mounted to the drive rod about a rotational axis. The linkage connector may comprise a stub. The stub may be aligned with the rotational axis of the linkage connector. The stub may engage the first stopper plate and the second stopper plate to set a first stop position and a second stop position of the first mechanical linkage. The linkage connector may comprise a shaft aligned with the rotational axis of the linkage connector. A linkage arm may be connected between the shaft and the belt. The linkage arm may be extensible and retractable between the shaft and the belt. The linkage connector may comprise a cam pin. The cam pin may be disposed such that the cam pin can enter and traverse the first curved track and the second curved track. When one of the first stop position and the second stop position is reached, the belt may be free to travel. When the drive rod reaches the first stop position and the second stop position, the cam pin may be positioned directly outside of one end of the first track and the second track, respectively. When the drive rod reaches the first stop position and the second stop position, the cam pin may traverse the first track and the second track, respectively, as the belt travels. When the drive rod reaches the first stop position and the second stop position, the linkage connector and cam pin may rotate about the shaft. When the drive rod reaches the first stop position and the second stop position, the linkage arm may follow the path of travel of belt and may rotate the shaft about its longitudinal axis to propel the cam pin through the first track and the second track, respectively. When the drive rod reaches the first stop position and the second stop position and the cam pin traverses the first track and the second track, respectively, the belt connector may follow the path of the belt. When the drive rod reaches the first stop position and the second stop position and the cam pin reaches an end of the first track and the second track, respectively, the belt connector may connect the drive rod to the belt.

In some embodiments, a RET actuator comprises a rotary drive element movable in a first rotary direction and a second rotary direction. A first drive system having a first linear output connected to the rotary drive element such that the first drive system moves the first linear output in a first linear direction and a second linear direction when the rotary drive element is moved in the first rotary direction. A second drive system having a second linear output connected to the rotary drive element such that the second drive system moves the second linear output in a third linear direction and a fourth linear direction when the rotary drive element is moved in the second rotary direction.

In some embodiments, a method of adjusting a phase shifter of a base station antenna comprising a remote electronic tilt ("RET") actuator, a plurality of phase shifters, a first mechanical linkage connected between the RET actuator and a first phase shifter, and a second mechanical linkage connected between the RET actuator and a second phase shifter is provided. The method comprises rotating a rotary drive element in one of a first rotary direction and a second rotary direction; actuating a first drive system connected between the rotary drive element and the first mechanical linkage in response the rotary drive element rotating in the first rotary direction, the first drive system moving the first mechanical linkage in a first linear direction and a second linear direction when the rotary drive element is moved in the first rotary direction; and actuating a second drive system connected between the rotary drive element and the second mechanical linkage in response the rotary drive element rotating in the second rotary direction, the second drive system moving the second mechanical linkage in a third linear direction and a fourth linear direction when the rotary drive element is moved in the second rotary direction.

DETAILED DESCRIPTION

Figure 1A:
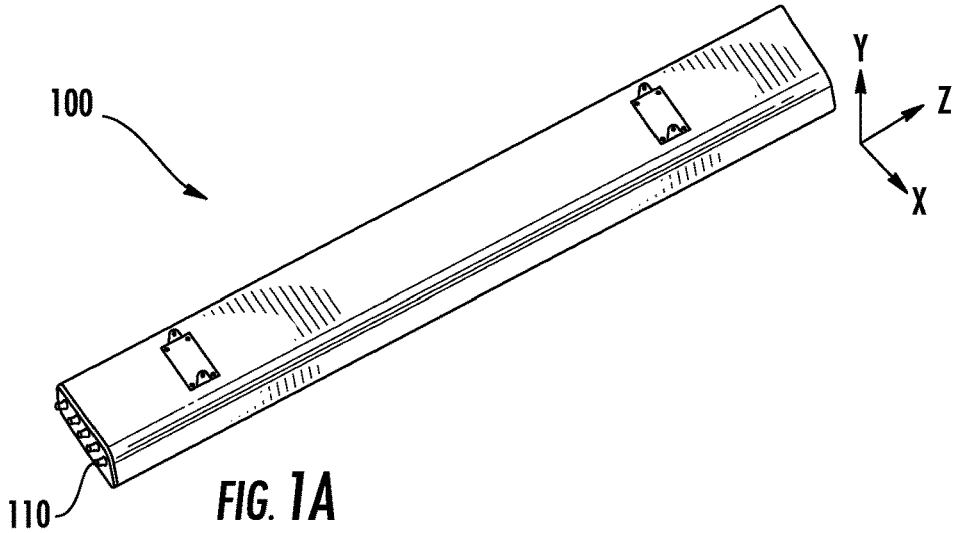
FIG. 1A is a perspective view of an example base station antenna according to embodiments of the present invention.

Modern base station antennas often include two, three or more arrays of radiating elements. If the arrays include cross-polarized radiating elements, then a separate phase shifter is provided for each polarization (i.e., two phase shifters per linear array). Moreover, separate transmit and receive phase shifters are often provided for each array so that the transmit and receive radiation patterns may be independently adjusted, which may again double the number of phase shifters. Additionally, in some cases, some (or all) of the arrays may be formed using wideband radiating elements that support service in multiple frequency bands (e.g., the 700 MHz and 800 MHz frequency bands or two or more frequency bands within the 1.7-2.7 GHz frequency range). When such wideband arrays are used, separate phase shifters may be provided for each frequency band within the broader operating frequency range of the radiating elements. Since base station antennas with two to as many as eight arrays of cross-polarized radiating elements are being deployed, it is not uncommon for a base station antenna to have eight, twelve or even twenty-four adjustable phase shifters for applying remote electronic down tilts to the arrays. As described above, RET actuators are provided in the antenna that are used to move elements on the phase shifters to adjust the down tilt angle of the antenna beams formed by the various arrays. While the same down tilt is typically applied to the phase shifters for the two different polarizations, allowing a single RET actuator and a single mechanical linkage to be used to adjust the phase shifters for both polarizations, modern base station antennas still often need four, six, twelve or even more RET actuators.

Conventionally, a separate RET actuator was provided for each phase shifter (or each pair of phase shifters if dual polarized radiating elements are used in a linear array). More recently, RET actuators have been proposed that may be used to move the wiper printed circuit board on as many as twelve phase shifters. For example, U.S. Patent Publication No. 2013/0307728 ("the '728 publication") discloses a RET actuator that may be used to drive six different mechanical linkages for purposes of adjusting six (or twelve) different phase shifters using one so-called "multi-RET actuator." U.S. Patent Publication No. 2017/0365923 ("the '923 publication") discloses a number of additional multi-RET actuator designs.

As more complex base station antennas are introduced, requiring ever increasing numbers of independently controlled phase shifters, it can become difficult to design base station antennas that fit within customer-demanded limitations on the size of the antenna. RET actuators also include expensive components, such as motors, such that as the number of independently controlled phase shifters increases the cost of providing the RET actuators also increases.

Pursuant to embodiments of the present invention, base station antennas are provided that include RET actuators that are less expensive to manufacture and may have a smaller physical footprint. In some embodiments, the RET actuators may include a single motor that controls more than one phase shifter and that can adjust the phase shifters in two different linear directions. The base station antennas pursuant to some embodiments of the present invention may include, among other things, a RET actuator, a plurality of phase shifters and a plurality of mechanical linkages, where each mechanical linkage is connected between the RET actuator and a respective one, or two, of the phase shifters. The RET actuator may comprise a drive element, a single motor that is selectively operably connected to one of a plurality of drive systems to move the selected one of the mechanical linkages in opposite linear directions.

Embodiments of the present invention will now be discussed in greater detail with reference to the drawings.

Figure 1B:
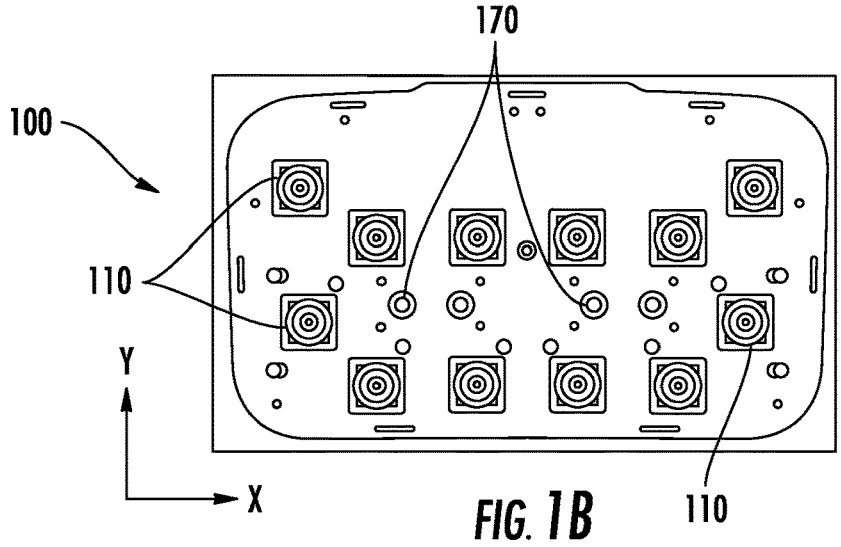
FIG. 1B is an end view of the base station antenna of FIG. 1A.
Figure 1C:
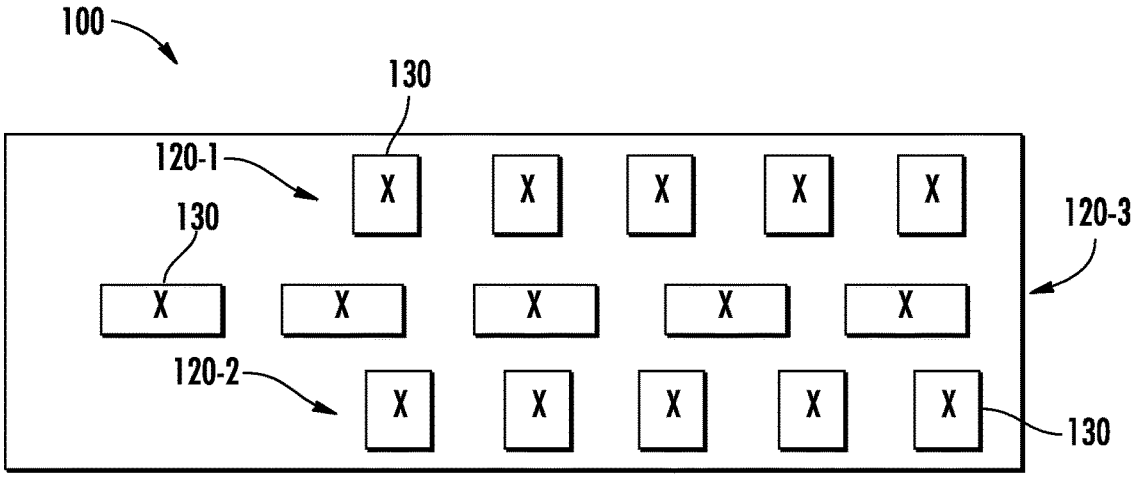
FIG. 1C is a schematic plan view of the base station antenna of FIG. 1A that illustrates three linear arrays of radiating elements thereof.
Figure 2:
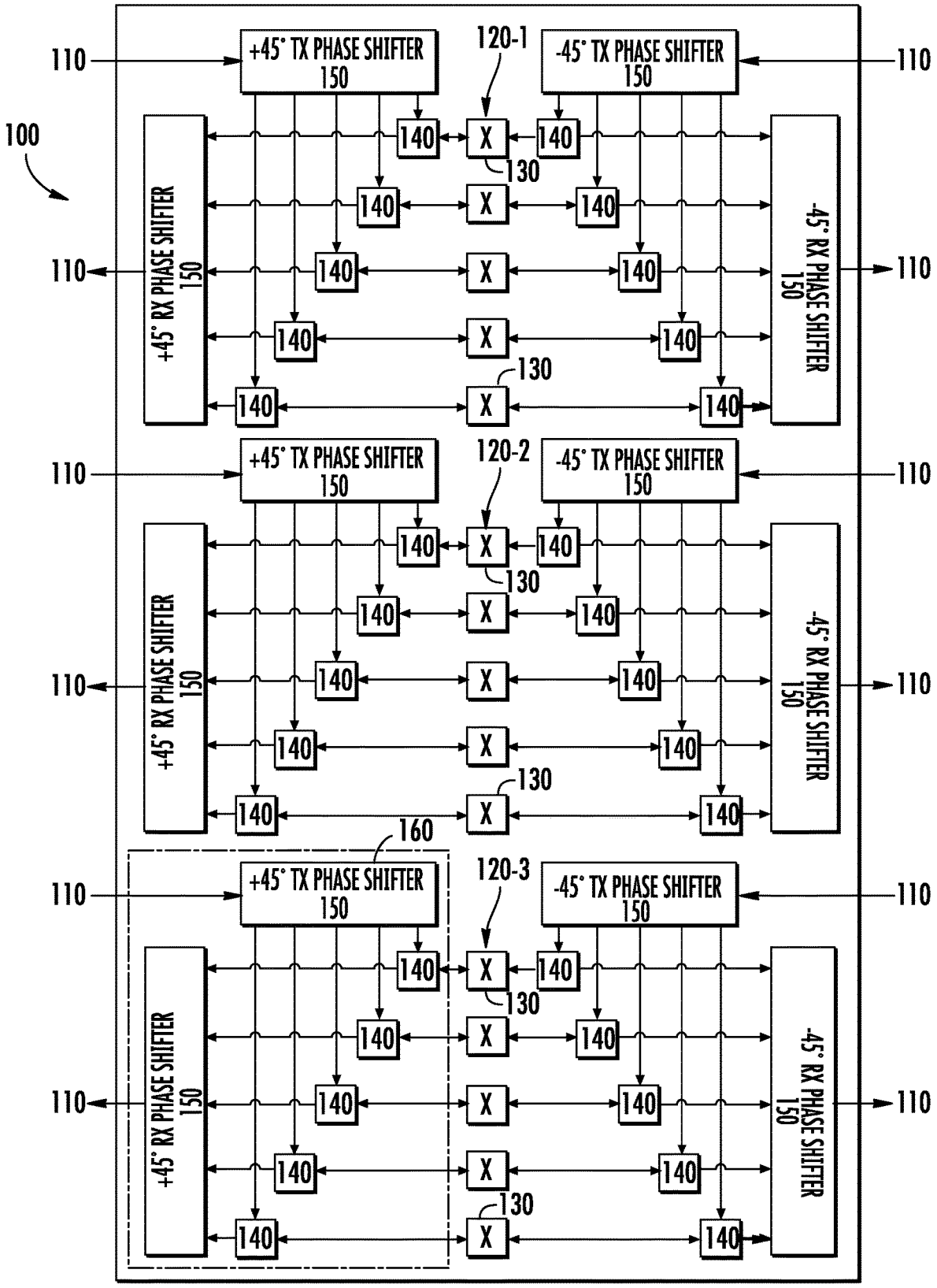
FIG. 2 is a schematic block diagram illustrating the electrical connections between various components of the base station antenna of FIGS. 1A-1C.

FIG. 1A is a perspective view of a base station antenna 100 that may include one or more of the RET actuators according to embodiments of the present invention. FIG. 1B is an end view of the base station antenna 100 that illustrates the input/output ports thereof. FIG. 1C is a schematic plan view of the base station antenna 100 (with the radome thereof removed) that illustrates three arrays of radiating elements thereof. FIG. 2 is a schematic block diagram illustrating various components of the base station antenna 100 and the electrical connections therebetween. It should be noted that FIG. 2 does not show the actual location of the various elements on the antenna, but instead is drawn to merely show the electrical transmission paths between the various elements.

Referring to FIGS. 1A-1C and 2, the base station antenna 100 includes, among other things, input/output ports 110, a plurality of arrays 120 of radiating elements 130, duplexers 140, phase shifters 150 and control ports 160. As shown in FIGS. 1C and 2, the base station antenna 100 may include a total of three arrays 120 (labeled 120-1 through 120-3) that each include five radiating elements 130. It will be appreciated, however, that the number of arrays 120 and the number of radiating elements 130 included in each of the arrays 120 may be varied. It will also be appreciated that different arrays 120 may have different numbers of radiating elements 130.

Referring to FIG. 2, the connections between the input/output ports 110, radiating elements 130, duplexers 140 and phase shifters 150 are schematically illustrated. Each set of an input port 110 and a corresponding output port 110, and their associated phase shifters 150 and duplexers 140, may comprise a corporate feed network. A dashed box is used in FIG. 2 to illustrate one of the six corporate feed networks included in antenna 100. Each corporate feed network connects the radiating elements 130 of one of the linear arrays 120 to a respective pair of input/output ports 110.

As shown schematically in FIG. 2 by the "X" that is included in each box, the radiating elements 130 may be cross-polarized radiating elements 130 such as +45°/−45° slant dipoles that may transmit and receive RF signals at two orthogonal polarizations. Any other appropriate radiating element 130 may be used including, for example, single dipole radiating elements or patch radiating elements (including cross-polarized patch radiating elements). When cross-polarized radiating elements 130 are used, two corporate feed networks may be provided per linear array 120, a first of which carries RF signals having the first polarization (e.g., +45°) between the radiating elements 130 and a first pair of input/output ports 110 and the second of which carries RF signals having the second polarization (e.g., −45°) between the radiating elements 130 and a second pair of input/output ports 110, as shown in FIG. 2.

As shown in FIG. 2, an input of each transmit ("TX") phase shifter 150 may be connected to a respective one of the input ports 110. Each input port 110 may be connected to the transmit port of a radio (not shown) such as a remote radio head. Each transmit phase shifter 150 has five outputs that are connected to respective ones of the radiating elements 130 through respective duplexers 140. The transmit phase shifters 150 may divide an RF signal that is input thereto into a plurality of sub-components and may effect a phase taper to the sub-components of the RF signal that are provided to the radiating elements 130. In a typical implementation, a linear phase taper may be applied to the radiating elements 130. As an example, the sub-component of the RF signal fed to the first radiating element 130 in a linear array 120 may have a phase of Y°+2X°, the sub-component of the RF signal fed to the second radiating element 130 in the linear array 120 may have a phase of Y°+X°, the sub-component of the RF signal fed to the third radiating element 130 in the linear array 120 may have a phase of Y°, the sub-component of the RF signal fed to the fourth radiating element 130 in the linear array 120 may have a phase of Y°−X°, and the sub-component of the RF signal fed to the fifth radiating element 130 in the linear array 120 may have a phase of Y°−2X°, where the radiating elements 130 are arranged in numerical order.

Similarly, each receive ("RX") phase shifter 150 may have five inputs that are connected to respective ones of the radiating elements 130 through respective duplexers 140 and an output that is connected to one of the output ports 110. The output port 110 may be connected to the receive port of a radio (not shown). The receive phase shifters 150 may effect a phase taper to the RF signals that are received at the five radiating elements 130 of the linear array 120 and may then combine those RF signals into a composite received RF signal. Typically, a linear phase taper may be applied to the radiating elements 130 as is discussed above with respect to the transmit phase shifters 150.

The duplexers 140 may be used to couple each radiating element 130 to both a transmit phase shifter 150 and to a receive phase shifter 150. As is well known to those of skill in the art, a duplexer is a three port device that (1) passes signals in a first frequency band (e.g., the transmit band) through a first port while not passing signals in a second band (e.g., a receive band), (2) passes signals in the second frequency band while not passing signals in the first frequency band through a second port thereof and (3) passes signals in both the first and second frequency bands through the third port thereof, which is often referred to as the "common" port.

As can be seen from FIG. 2, the base station antenna 100 may include a total of twelve phase shifters 150. While the two transmit phase shifters 150 for each linear array 120 (i.e., one transmit phase shifter 150 for each polarization) may not need to be controlled independently (and the same is true with respect to the two receive phase shifters 150 for each linear array 120), there still are six sets of two phase shifters 150 that should be independently controllable.

The RET actuators that are used to physically adjust the settings of the phase shifters 150 are typically spaced apart from the phase shifters 150. So-called mechanical linkages 170 are used to transfer the motion of a RET actuator to a moveable element of a phase shifter. Each RET actuator may be controlled to generate a desired amount of movement of an output member thereof. The movement may comprise, for example, linear movement or rotational movement. A mechanical linkage 170 is used to translate the movement of the output member of the RET actuator to movement of a moveable element of a phase shifter 150 (e.g., a wiper arm, a sliding dielectric member, etc.). The mechanical linkage 170 may comprise, for example, one or more plastic or fiberglass RET rods 172 that extend between the output member of the RET actuator and the moveable element of the phase shifter 150.

Each phase shifter 150 shown in FIG. 2 may be implemented, for example, as a rotating wiper phase shifter. The phase shifts imparted by a phase shifter 150 to each sub-component of an RF signal may be controlled by a mechanical positioning system that physically changes the position of the rotating wiper of each phase shifter 150, as will be explained with reference to FIG. 3.

Figure 3:
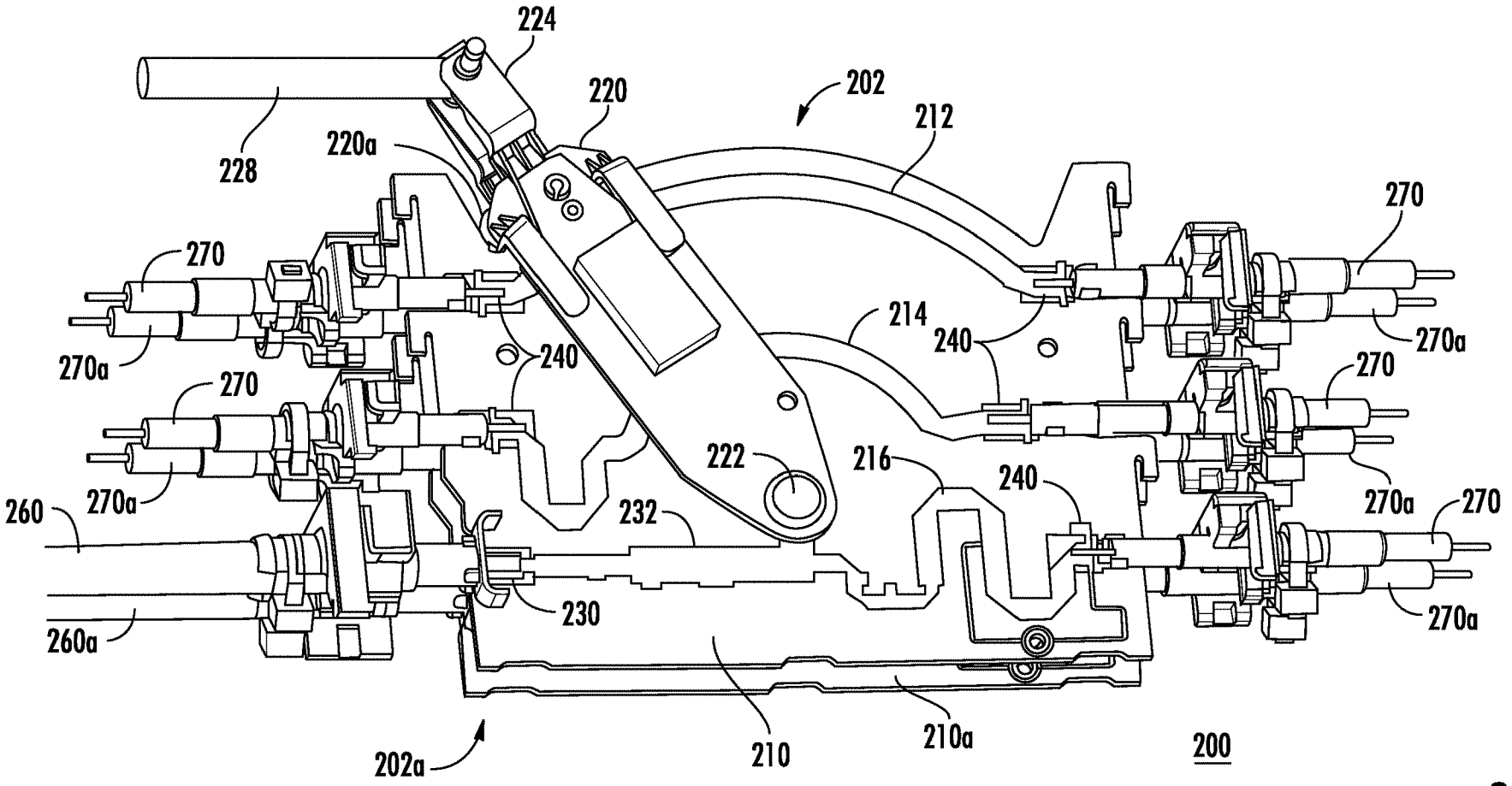
FIG. 3 is a front perspective view of a pair of electromechanical phase shifters that may be included in the base station antenna of FIGS. 1A-2.

Referring to FIG. 3, a dual rotating wiper phase shifter assembly 200 is illustrated that may be used to implement, for example, two of the phase shifters 150 of FIG. 2 (one for each of the two polarizations). The dual rotating wiper phase shifter assembly 200 includes first and second phase shifters 202, **202*a*. In the description of FIG. 3 that follows it is assumed that the two phase shifters 202, 202*a*** are each transmit phase shifters that have one input and five outputs.

It will be appreciated that if the phase shifters 202, 202*a* are instead used as receive phase shifters then the terminology changes, because when used as receive phase shifters there will be five inputs and a single output.

As shown in FIG. 3, the dual phase shifter 200 includes first and second main (stationary) printed circuit boards 210, 210*a* that are arranged back-to-back as well as first and second rotatable wiper printed circuit boards 220, 220*a* (wiper printed circuit board 220*a* is barely visible in the view of FIG. 3) that are rotatably mounted on the respective main printed circuit boards 210, 210*a*. The wiper printed circuit boards 220, 220*a* may be pivotally mounted on the respective main printed circuit boards 210, 210*a* via a pivot pin 222. The wiper printed circuit boards 220, 220*a* may be joined together at their distal ends via a bracket 224.

The position of each rotatable wiper printed circuit boards 220, 220*a* above its respective main printed circuit board 210, 210*a* is controlled by the position of a mechanical linkage 170 (with a RET rod 172 partially shown in FIG. 3) that extends between an output member of a RET actuator and the phase shifter 200.

Each main printed circuit board 210, 210*a* includes transmission line traces 212, 214. The transmission line traces 212, 214 are generally arcuate. In some cases the arcuate transmission line traces 212, 214 may be disposed in a serpentine pattern to achieve a longer effective length. In the example illustrated in FIG. 3, there are two arcuate transmission line traces 212, 214 per main printed circuit board 210, 210*a* (the traces on printed circuit board 210*a* are not visible in FIG. 3), with the first arcuate transmission line trace 212 being disposed along an outer circumference of each printed circuit board 210, 210*a*, and the second arcuate transmission line trace 214 being disposed on a shorter radius concentrically within the outer transmission line trace 212. A third transmission line trace 216 on each main printed circuit board 210, 210*a* connects an input pad 230 on each main printed circuit board 210, 210*a* to an output pad 240 that is not subjected to an adjustable phase shift.

The main printed circuit board 210 includes an input trace 232 leading from the input pad 230 near an edge of the main printed circuit board 210 to the position where the pivot pin 222 is located. RF signals on the input trace 232 are coupled to a transmission line trace (not visible in FIG. 3) on the wiper printed circuit board 220, typically via a capacitive connection. The transmission line trace on the wiper printed circuit board 220 may split into two secondary transmission line traces (not shown). The RF signals are capacitively coupled from the secondary transmission line traces on the wiper printed circuit board 220 to the transmission line traces 212, 214 on the main printed circuit board. Each end of each transmission line trace 212, 214 may be coupled to a respective output pad 240. A coaxial cable 260 or other RF transmission line component may be connected to input pad 230. A respective coaxial cable 270 or other RF transmission line component may be connected to each respective output pad 240. As the wiper printed circuit board 220 moves, an electrical path length from the input pad 230 of phase shifter 202 to each radiating element 130 served by the transmission lines 212, 214 changes. For example, as the wiper printed circuit board 220 moves to the left it shortens the electrical length of the path from the input pad 230 to the output pad 240 connected to the left side of transmission line trace 212 (which connects to a first radiating element 130), while the electrical length from the input pad 230 to the output pad 240 connected to the right side of transmission line trace 212 (which connects to a second radiating element) increases by a corresponding amount. These changes in path lengths result in phase shifts to the signals received at the output pads 240 connected to transmission line trace 212 relative to, for example, the output pad 240 connected to transmission line trace 216.

The second phase shifter 202*a* may be identical to the first phase shifter 202. As shown in FIG. 3, the rotating wiper printed circuit board 220*a* of phase shifter 202*a* may be controlled by the same mechanical linkage 170 as the rotating wiper printed circuit board 220 of phase shifter 202. For example, if a linear array 120 includes dual polarized radiating elements 130, typically the same phase shift will be applied to the RF signals transmitted at each of the two orthogonal polarizations. In this case, a single mechanical linkage 170 may be used to control the positions of the wiper printed circuit boards 220, 220*a* on both phase shifters 202, 202*a*.

Figure 4:
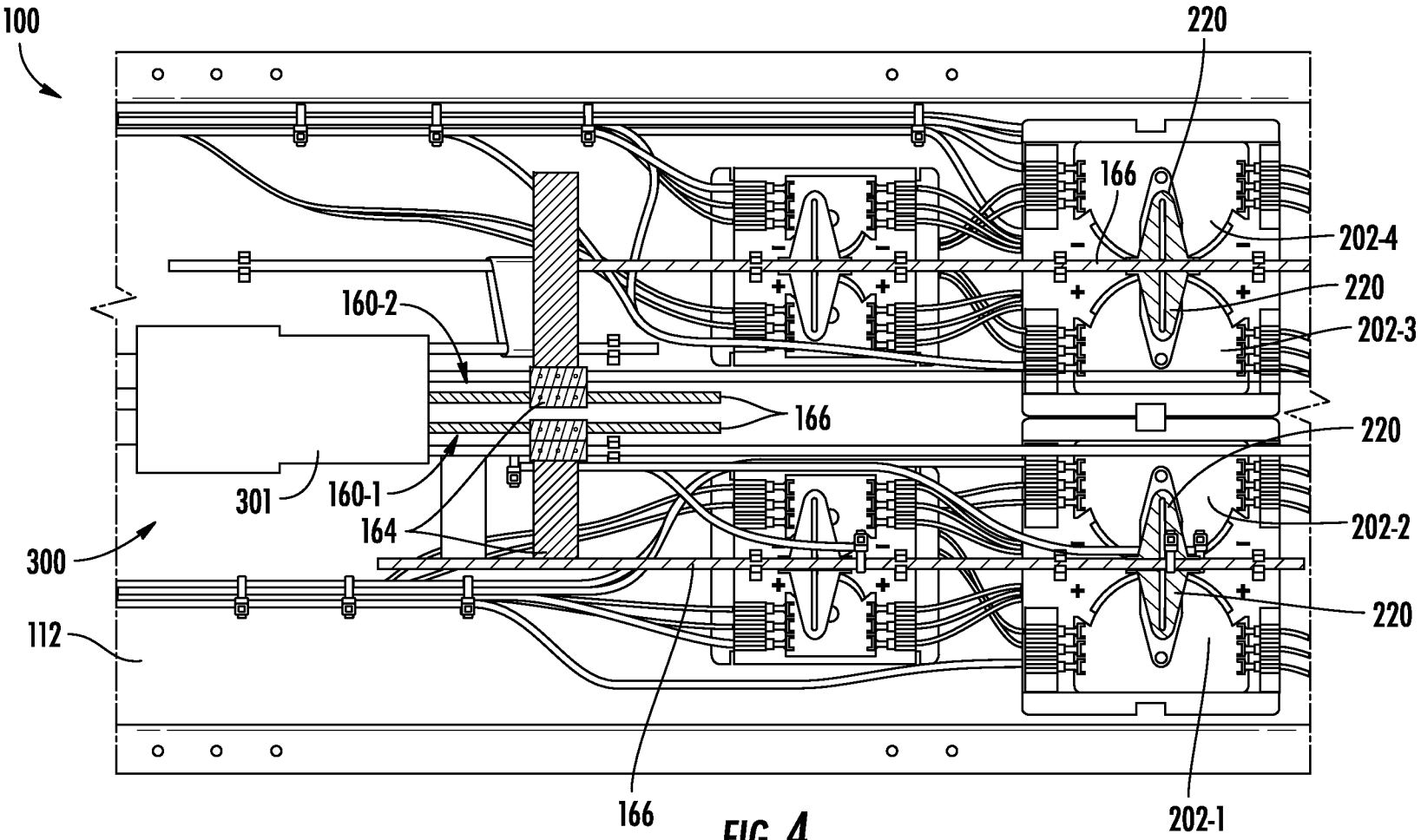
FIG. 4 is a rear view of a portion of the RET base station antenna of FIGS. 1A-3 that shows one embodiment of how mechanical linkages are used to connect the output members of the RET actuator to respective ones of the phase shifters illustrated in FIG. 3.

FIG. 4 is a rear view of a portion of the base station antenna 100 that shows how mechanical linkages 160-1 and 160-2 are used to connect the output members of the RET actuator 300 to moveable elements 220, 220*a* of respective pairs of phase shifters 202-1 through 202-4. The mechanical linkages 160-1 and 160-2 are shaded in FIG. 4 to better show the connection of the mechanical linkage 160-1 to the phase shifters 202-1 and 202-2 and the connection of mechanical linkage 160-2 from the RET actuator 300 to the phase shifters 202-3 and 202-4. The RET actuator 300 is mounted in the antenna 100 behind the backplane 112. Multiple pairs of phase shifters may be mounted rearwardly of the backplane 112 (only four pairs of phase shifters are visible in FIG. 4). Since the base station antenna 100 has linear arrays 120, 130 that are formed of dual-polarized radiating elements 122, 132, the phase shifters 202 are mounted in pairs since the phase shifter 202 for each polarization will be adjusted the same amount. The RET actuator 300 is connected to the phase shifters 202-1 to 202-4 by mechanical linkages 160-1 and 160-2. The mechanical linkages 160-1 and 160-2 are provided to connect each output member of the RET actuator 300 to a respective pair of phase shifters 202. The other phase shifters shown in FIG. 4 are connected to the RET actuator 300 by additional mechanical linkages and additional phase shifters and mechanical linkages may be provided in the antenna; however, only mechanical linkages 160-1, 160-2 are specifically referenced to simplify the illustrated system. Each mechanical linkage 160-1, 160-2 may comprise a plurality of RET rods 166 connected by linkages 164. The RET rods 166 may comprise, for example, generally rigid fiberglass or plastic longitudinally-extending rods. The RET rods 166 typically extend in a longitudinal direction of the antenna 100, while the RET linkages 164 typically extend along the width and/or depth axes to connect two RET rods 166 together, and/or to connect a RET rod 166 to an output member of the RET actuator or to a moveable element of a phase shifter assembly. Each mechanical linkage 160-1, 160-2 is used to transfer a linear movement of the output member of the RET actuator 300 to a wiper board 220 of a phase shifter, although in other embodiments rotational movement may be transferred by the mechanical linkage. In some embodiments, a single RET rod may comprise the mechanical linkages 160-1, 160-2 while in other embodiments, a greater number of RET rods and linkages may be used. Other mechanical linkages shown in FIG. 4 may include similar combinations of RET rods 166 and RET linkages 164 which may be operatively coupled between additional RET actuators 300 and phase shifters.

Figure 5:
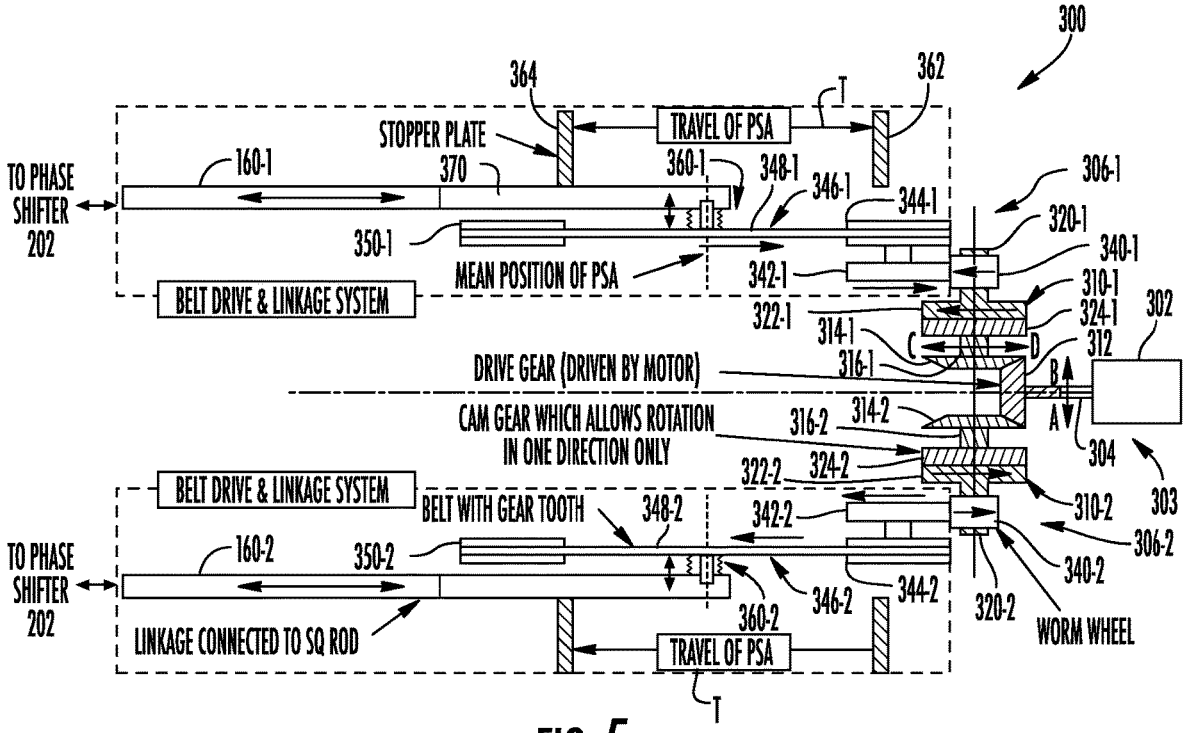
FIG. 5 is a schematic top view of an embodiment of the RET actuator of the invention.

FIGS. 5 through 17 illustrate the RET actuator 300 of FIG. 4 in greater detail. The RET actuator 300 may comprise a housing 301 (FIG. 4) that houses the components of the RET actuator 300. Referring to FIG. 5, the RET actuator 300 comprises a single rotary drive element 303 comprising a reversible motor 302 such as a reversible electric motor having a rotary output 304. Output 304 from motor 302 is coupled to a drive gear 312 such that the drive gear 312 may be rotated in either direction as represented by arrows A and B in FIG. 5. In one embodiment, the drive gear 312 comprises a bevel gear.

The output of the reversible rotary drive element 303 is selectively connected to one of a plurality of drive systems 306-1, 306-2 that are in turn connected to mechanical linkages 160-1, 160-2 that transmit the output of the drive systems 306-1, 306-2 to phase shifters 202. Each of the drive systems 306-1, 306-2 is connected to one phase shifter 202 through a mechanical linkage 160-1 and 160-2, respectively, such that the illustrated RET actuator 300 controls two phase shifters 202. One-way clutch drives 310-1, 310-2 selectively connect the output of the rotary drive element 303 to one of the drive systems 306-1, 306-2.

Because the drive systems 306-1, 306-2 and the one-way clutch drives 310-1, 310-2 are substantially identical to one another, drive system 306-1 and one-way clutch drive 310-1 will be described in detail with it being understood that drive system 306-2 and one-way clutch drive 310-2 are structured and operate in substantially the same way.

Drive gear 312 is coupled to a driven gear 314-1 that also comprises a bevel gear. Rotation of drive gear 312 in the direction of arrow A by motor 302 rotates driven gear 314-1 in the direction of arrow C, while rotation of drive gear 312 in the direction of arrow B by motor 302 rotates driven gear 314-1 in the direction of arrow D.

Figure 6:
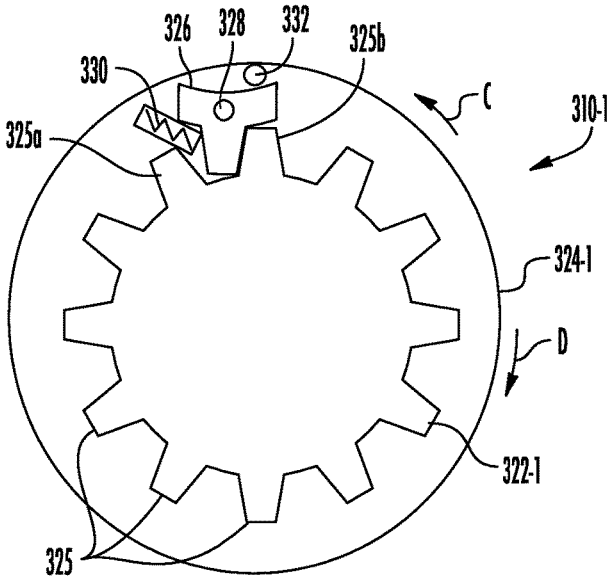
FIG. 6 is a side view of a one-direction clutch used in the RET actuator of FIG. 4.
Figure 7:
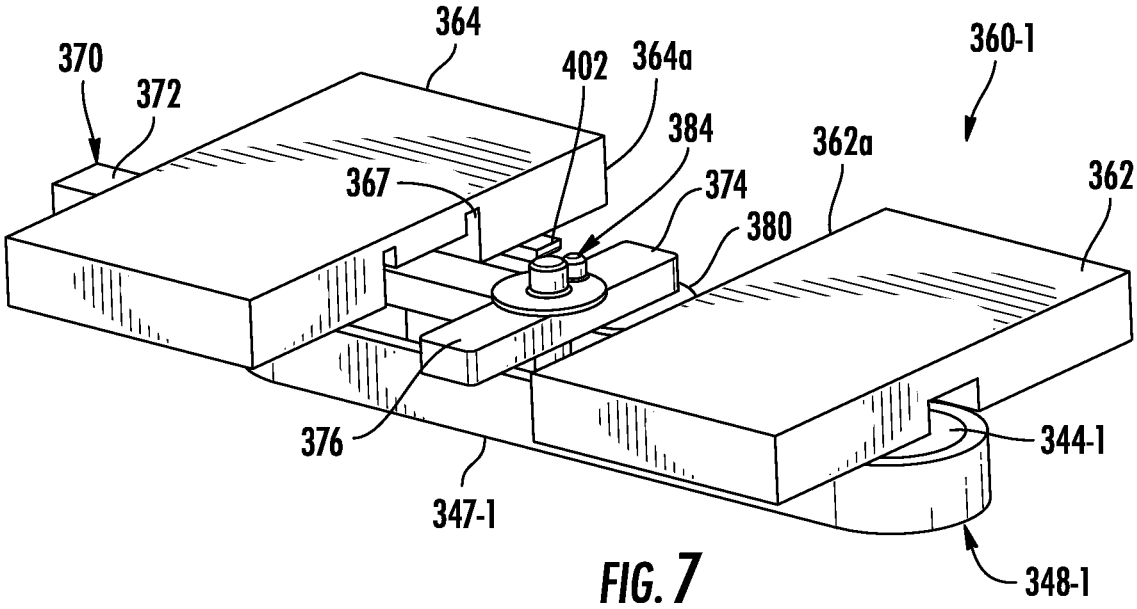
FIG. 7 is a perspective view of an embodiment of a drive system used in the RET actuator of FIG. 4.
Figure 8:
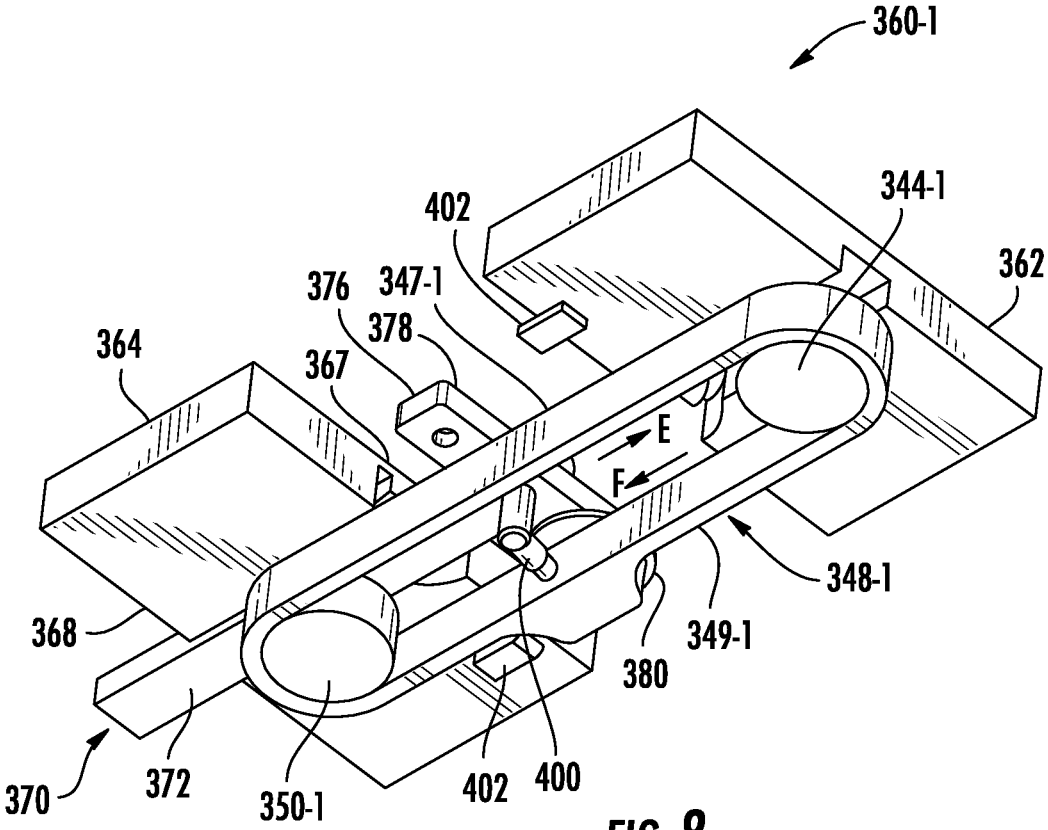
FIG. 8 is another perspective view of the drive system of FIG. 7.
Figure 9:
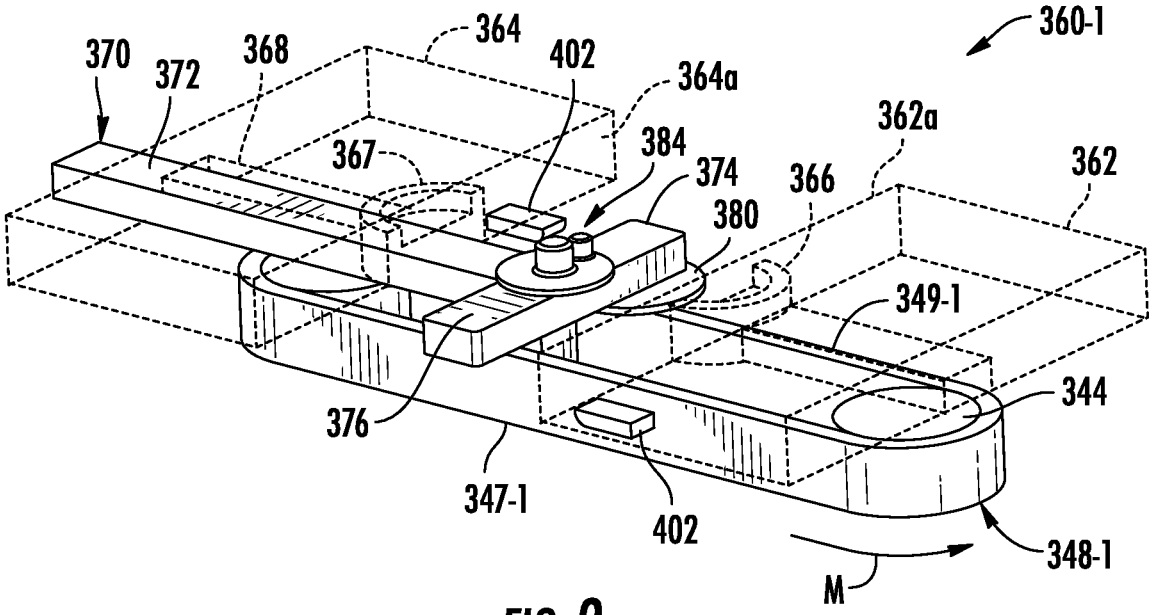
FIG. 9 is another perspective view of the drive system of FIG. 7 shown in partial phantom lines.
Figure 10:
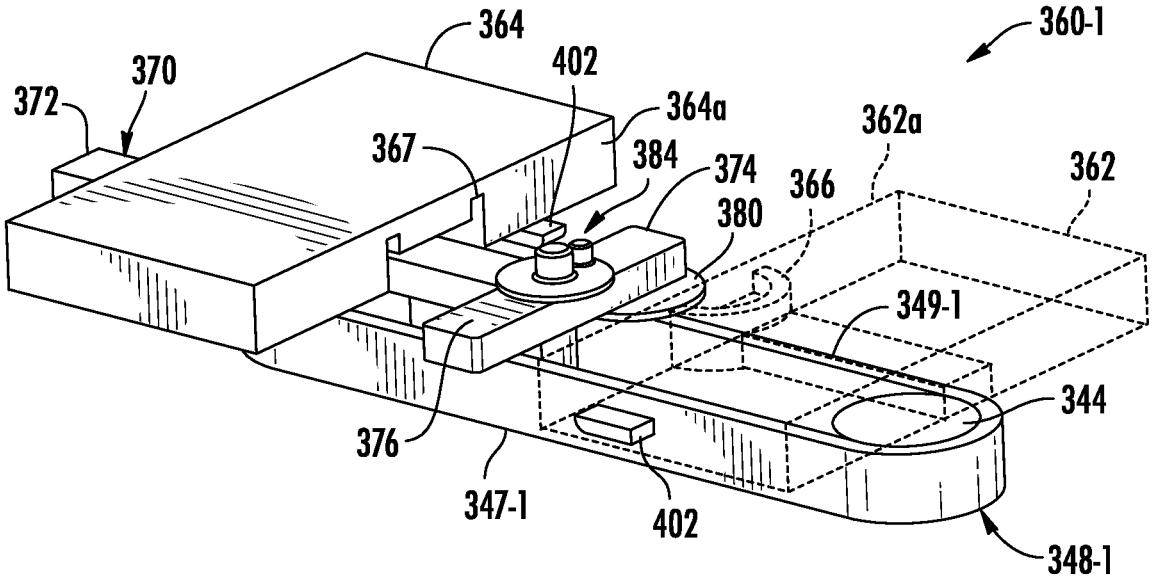
FIG. 10 is another perspective view of the drive system of FIG. 7 shown in partial phantom lines.

The output 316-1 of driven gear 314-1 is coupled to clutch 310-1. Clutch 310-1 is configured to transmit rotation of driven gear 314-1 in direction C to the clutch output 320-1 but to not transmit rotation of driven gear 314-1 in direction D to the clutch output 320-1. Referring more specifically to FIG. 6, in one embodiment, clutch 310-1 comprises a cam gear 324-1 operably coupled to the driven gear output 316-1 such that the cam gear 324-1 and the driven gear output 316-1 rotate together on a common axis. Clutch 310-1 also comprises a toothed ratchet wheel 322-1 operably coupled to the clutch output 320-1 such that the ratchet wheel 322-1 and the clutch output 320 rotate together on a common axis. The cam gear 324-1 and the ratchet wheel 322-1 are independently rotatable relative to one another about a common axis of rotation.

As shown in FIG. 6, the ratchet wheel 322-1 comprises a plurality of teeth 325 spaced about the periphery thereof. The cam gear 324-1 supports a pawl 326 on a pivot pin 328 such that the pawl 326 can pivot relative to the cam gear 324-1. A spring 330 biases the pawl 326 into engagement with the teeth 325 on ratchet wheel 322-1. A stop 332 is positioned such that when the pawl 326 is engaged with the stop 330 the pawl 326 is prevented from rotating counterclockwise about pivot pin 328 as viewed in FIG. 6.

In operation of the clutch 310-1, when the driven gear 314-1 and cam gear 324-1 are rotated in the direction of arrow C (by the rotation of motor 302 in direction A), the pawl 326, which is carried by the cam gear 324-1, is moved into engagement with the tooth 325*a* immediately forward of the pawl 326. Pawl 326 is driven into engagement with stop 332 such that continued rotation of cam gear 324-1 in direction C causes the ratchet wheel 322-1 to rotate with the cam gear 324-1. When the driven gear 314-1 and cam gear 324-1 are rotated in the direction of arrow D (by the rotation of motor 302 in direction B), the pawl 326, which is carried by the cam gear 324-1, is moved into engagement with the tooth 325*b* immediately behind the pawl 326. The engagement of tooth 325*b* with pawl 326 rotates pawl 326 away from stop 332 such that tooth 325*b* and each successive tooth 325 can pass the pawl 326 such that rotation of cam gear 324-1 in direction D does not rotate the ratchet wheel 322-1. The spring 330 returns the pawl 326 to the engaged position when movement of the cam gear 324-1 stops. Thus, rotation of the motor 302 in a first direction A causes rotation of ratchet wheel 322-1 and clutch output 320-1 while rotation of the motor 302 in the second opposite direction B, does not result in movement of the ratchet wheel 322-1 and clutch output 320-1.

Clutch 310-2 is arranged with the opposite orientation such that rotation of the motor in direction B, causes the rotation of ratchet wheel 322-2 and clutch output 320-2 while rotation of the motor 302 in the direction A, does not cause movement of the ratchet wheel 322-2 and clutch output 320-2. As a result, the drive systems 306-1 and 306-2 may be selectively actuated based on the direction of rotation of motor 302. While the motor 302 is driven in a first direction to actuate drive system 306-1 and in a second direction to actuate drive system 306-2, the drive systems 306-1 and 306-2 are configured such that rotation of the motor 302 in either of the directions A and B controls movement of the associated mechanical linkages 160-1, 160-2 in two linear directions as will hereinafter be described.

A worm gear 340-1 is mounted for rotation with the clutch output 320-1 and engages a mating gear 342-1 to transmit rotation of the output 320-1 to the two-way drive system 306-1. The use of a worm gear 340-1 to drive mating gear 342-1 has the advantage that, while the worm gear 340-1 can rotate the mating gear 342-1, the mating gear 342-1 cannot rotate the worm gear 340-1. As a result, when the system is not activated, the worm gear 340-1 locks the drive system 306-1 in place such that inadvertent movement of the drive system and associated mechanical linkage does not occur.

The mating gear 342-1 is operatively coupled to a toothed pulley 344-1 of belt drive 346-1 such that the rotation of mating gear 342-1 causes the rotation of the pulley 344-1. A toothed belt 348-1 runs over toothed pulley 344-1 and a second toothed pulley 350-1 such that the belt 348-1 may be driven in a first rotational direction when motor 302 is driven in the direction of arrow A. The belt 348-1 has two runs 347-1 and 349-1 (FIG. 8) between the pulleys 344-1, 350-1. A top run 347-1 moves in a first linear direction E away from the phase shifter 202 and a bottom run 349-1 moves in a second linear direction F toward from the phase shifter 202. The first linear direction E may be considered the retraction direction and the second linear direction F may be considered the extension direction. The linkage system 360-1 allows the mechanical linkage 160-1 to be moved in a first linear direction when the linkage system 360-1 is coupled to the top run 347-1 of belt 348-1 and in a second linear direction when the linkage system 360-1 is coupled to the bottom run 349-1 of belt 348-1. The terms "top run" and "bottom run" are used to distinguish the two portions of belt 348-1 between pulleys 344-1 and 350-1 and are not intended to describe a spatial orientation of the belt drive in use. In actual use, the RET drive 300 may have any spatial orientation such that either run may be above or below the other run and the runs may also be disposed in a side-by-side orientation or at any angle relative to the horizon.

Figure 11:
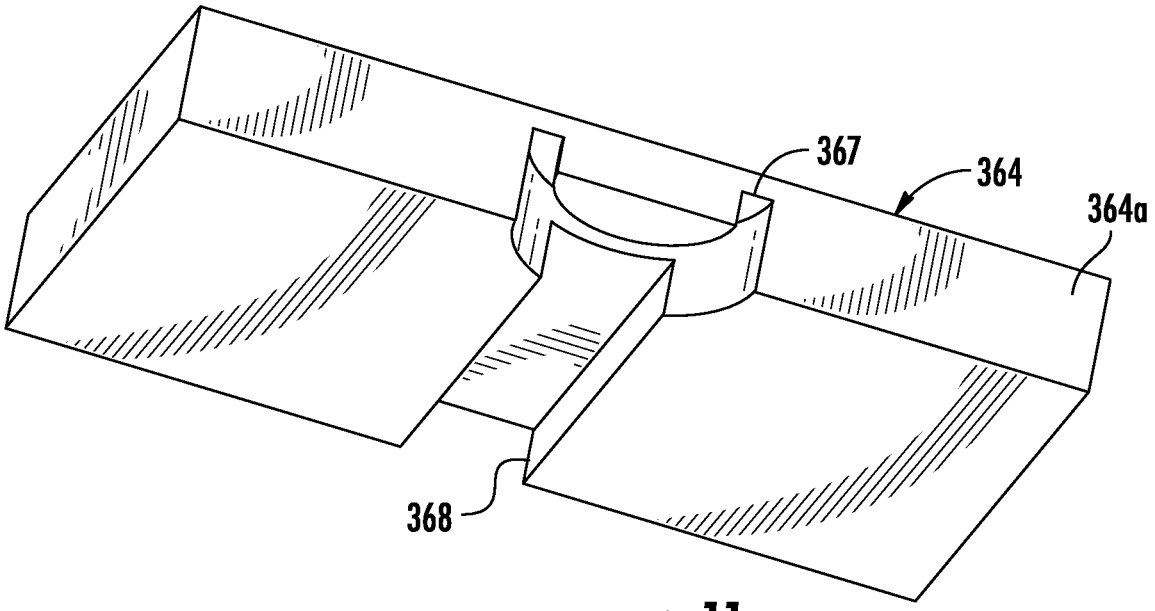
FIG. 11 is a perspective view of an embodiment of a stopper plate used in the drive system of FIG. 7.
Figure 12:
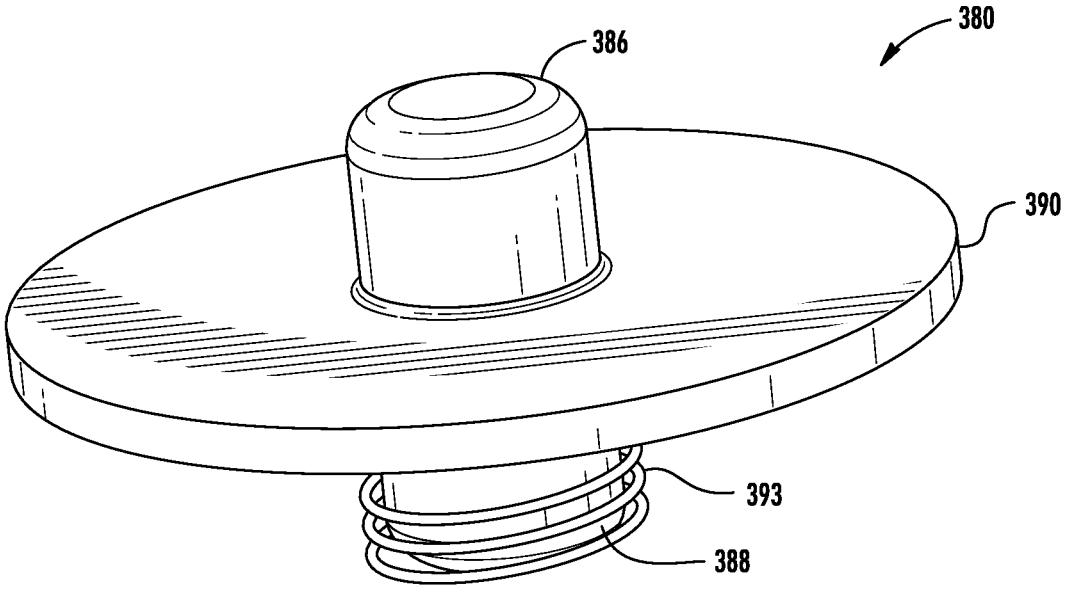
FIG. 12 is a perspective view of an embodiment of the connector used in the drive system of FIG. 7.
Figure 13:
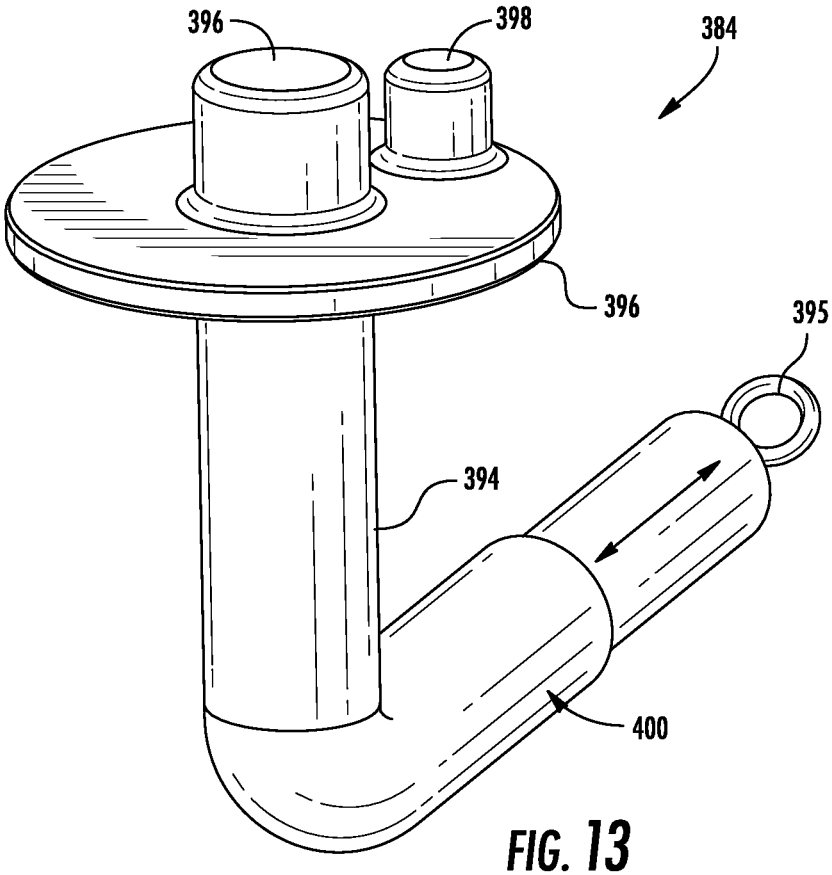
FIG. 13 is a perspective view of an embodiment of the linkage connector used in the drive system of FIG. 7.
Figure 14:
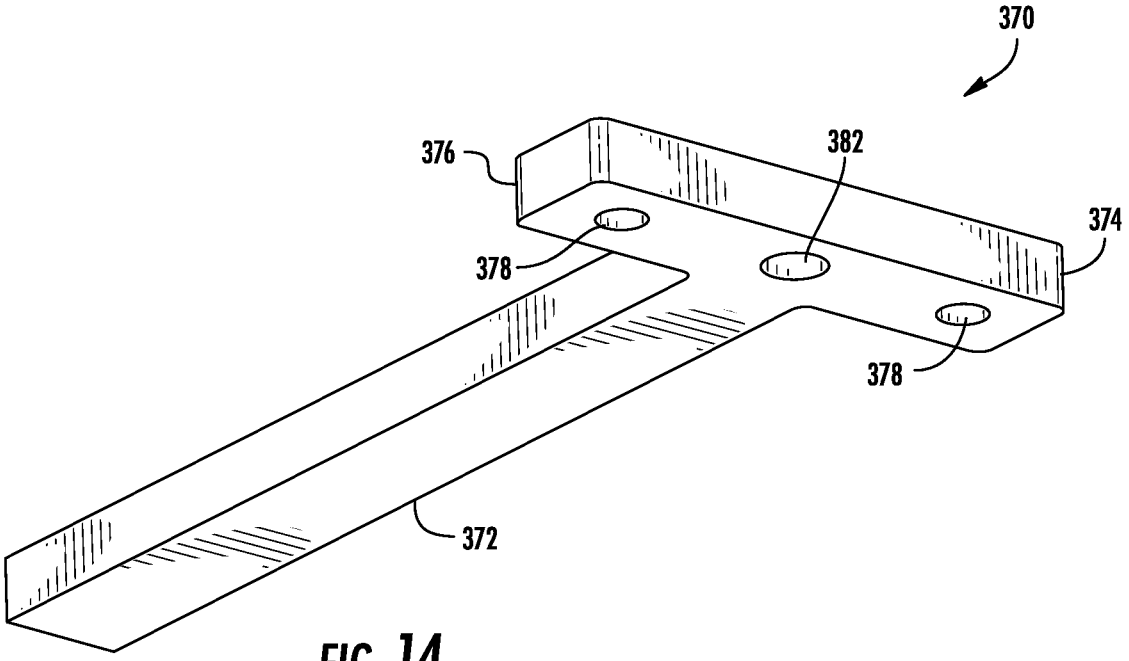
FIG. 14 is a perspective view of an embodiment of a drive rod used in the drive system of FIG. 7.

The linkage system 360-1 will be described in greater detail with reference to FIGS. 7 through 17. The linkage system 360-1 comprises a first stopper plate 362 and a second stopper plate 364 (FIG. 11). The first stopper plate 362 is positioned over the toothed pulley 344-1 and the second stopper plate 364 is positioned over the toothed pulley 350-1. The stopper plates 362, 364 have substantially semicircular tracks 366, 367, respectively, formed therein where the tracks 366, 367 face one another and open inwardly toward one another. The stopper plate 364 also includes a longitudinally extending track 368 for receiving a drive rod 370 such that the drive rod 370 can linearly reciprocate in the track 368. While only the second stopper plate 364 requires the longitudinally extending track 368, both stopper plates 362, 364 may be identical to reduce component count. The distance T (FIG. 5) between the facing sides 362*a* and 364*a* of stopper plates 362, 364, respectively, sets the distance of travel of the drive rod 370 and the mechanical linkage 160-1. This distance T may be varied by increasing or decreasing the distance between stopper plates 362, 364. The maximum range of the adjustment of the phase shifter is determined by the length of the belts 348-1, 348-2. In some embodiments, the maximum travel range is 68 mm but 0-10 degrees of tilt may be obtained for an antenna with the phase shifter moving by 30 mm (these values depend on antenna length, tilt value etc.).

Drive rod 370 (FIG. 14) has a generally T-shape with the longitudinal leg 372 of drive rod 370 supported in the track 368. The leg 372 is reciprocally mounted in the track 368 such that it can move linearly along its length relative to stopper plate 364. The linear movement of leg 372 corresponds to the linear movement of the mechanical linkage 160-1 that is connected to the drive rod 370. The leg 372 may be directly coupled to a RET rod or other linkage to transfer movement of the drive rod 370 to the mechanical linkage 160-1.

The drive rod 370 also includes two extending arms 374, 376 that extend from leg 372 and are disposed at substantially right angles relative thereto. One of the arms 374, 376 extends over one of the runs 347-1, 349-1 of the belt 348-1, respectively. Each arm 374, 376 includes an engagement structure 378 located near the distal end of the arm and positioned to engage a belt connector 380 that is mounted on and carried by belt 348-1. In the illustrated embodiment the engagement structure comprises an aperture. A through-hole 382 is formed between the arms 374, 376 along the longitudinal axis of the drive rod 370 for receiving a linkage connector 384.

Figure 15:
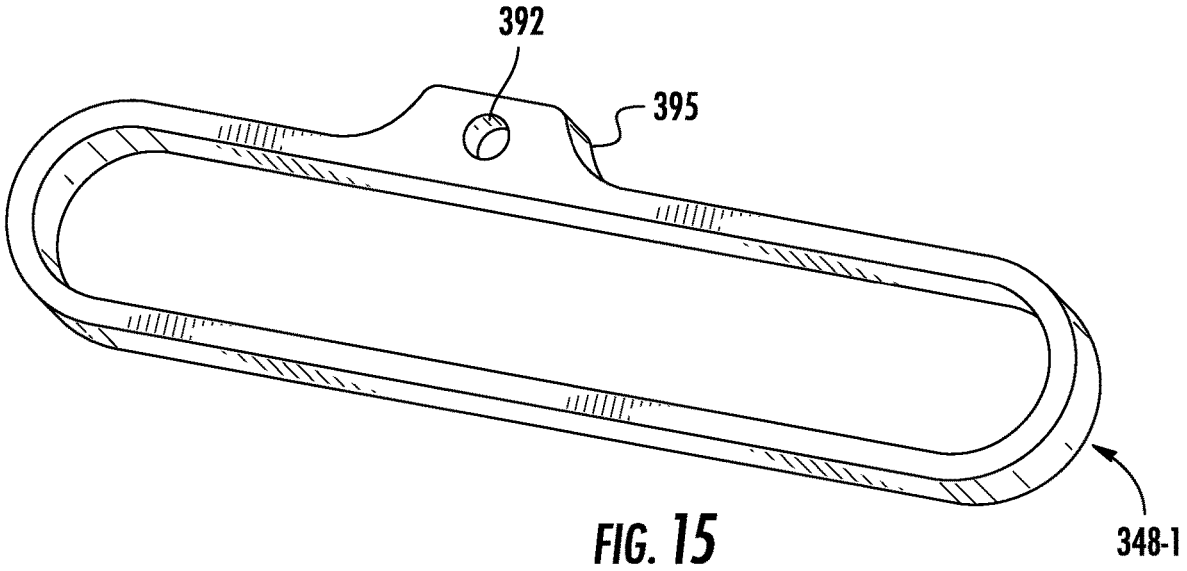
FIG. 15 is a perspective view of an embodiment of a drive belt used in the drive system of FIG. 7.
Figure 16:
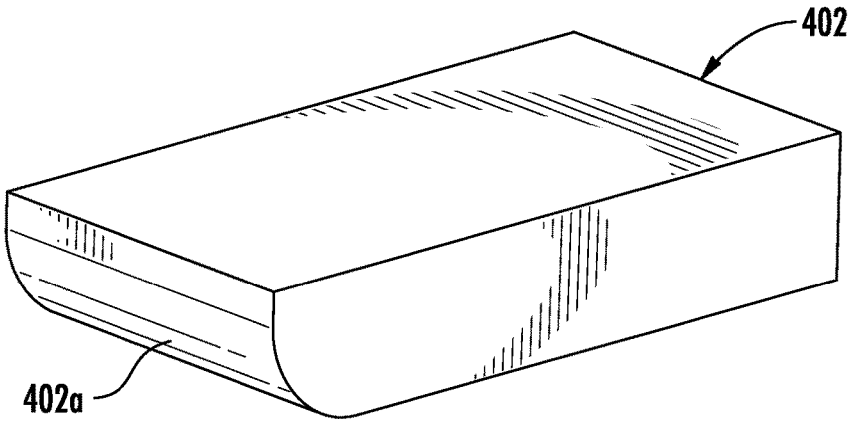
FIG. 16 is a perspective view of an embodiment of a camming plate used in the drive system of FIG. 7.

The belt connector 380 (FIG. 12) comprises a flat flange 390 having a first engagement structure 386 extending from one side thereof. The engagement structure 386 can releasably connect to the engagement structure 378 on the arms 374, 376 of the drive rod 370. The engagement structure 386 in the illustrated embodiment comprises pin that fits into the apertures 378 on arms 374, 376. The aperture 378 and pin 386 may be reversed such that the pin is formed on the arm and the aperture is formed on the belt connector in other embodiments. Moreover, other engagement structures may be used provided that the engagement structures may be released by moving the belt connector 380 away from the arms 374, 376 as will be described. A second pin 388 extends from the opposite side of flange 390. While the flange 390 is show as circular, the flange 390 may have any shape. The first pin 386 may be slidably received in either of the apertures 378 on arms 374, 376 such that the first pin 386 may be removed from the apertures 378 by moving the pin 386 along its longitudinal axis away from arms 374, 376 and out of the apertures 378. The second pin 388 is received in an aperture 392 formed on the belt 348-1 (FIG. 15). The belt 348-1 may include a thickened portion 395 that defines the aperture 392. A biasing mechanism such as a compression spring 393 is disposed in the aperture 392 and engages the belt connector 380 to bias the belt connector 380 away from the belt 348-1 and toward the drive rod 370. When the first pin 386 is engaged with one of the apertures 378 on arms 374, 376 and the second pin 388 is engaged with the belt 348-1, the drive rod 370 is connected to and moves with the belt 348-1.

The linkage connector 384 (FIG. 13) comprises a shaft 394 that extends from a first side of flange 396. The shaft 394 is rotatably supported in the through-hole 382 in drive rod 370 such that the linkage connector 384 may rotate about shaft 394 relative to the drive rod 370. A stub 396 extends from a second side of the disk 396 opposite to shaft 394. The stub 396 is coaxially disposed with the shaft 394 along the rotational axis of the linkage connector 384. A cam pin 398 also extends from the second side of the disk 396 radially spaced from the stub 396. The cam pin 398 is disposed such that it can enter and traverse the track 366 in the first stopper plate 362 and the track 367 in the second stopper plate 364. A linkage arm 400 is connected between the shaft 394 and the belt 348-1. The distal end of the linkage arm 400 remote from shaft 394 connects to the belt 348-1 at the location of aperture 392 by a suitable pivoting connector 395. The pivoting connector may connect to the underside of belt 348-1. The linkage arm 400 is extensible along its longitudinal axis between the shaft 394 and the belt 348-1. The linkage arm 400 may comprise a telescoping arm, spring, spring cylinder, pneumatic or hydraulic cylinder where the length of the linkage arm 400 is freely extensible and retractable.

A camming plate 402 (FIG. 16) is positioned at the leading edge of each of the stopper plates 362, 364. Each camming plate 362, 364 is aligned with the belt connector 380. The camming plate 402 may be mounted to the bottom of stopper plates 362, 364, as shown, or the camming plates 402 may be mounted on other structures. Each camming plate 402 may comprise a member having a tapered or beveled leading edge 402*a* that is positioned to engage the first side of the flange 390 of belt connector 380 as the belt connector 380 approaches the stopper plates 362, 364. The beveled leading edge 402*a* of camming plate 402 is inserted between the flange 390 and the arms 374, 376 to drive the belt connector 380 against the bias of spring 393 and away from arms 374, 376. The camming plate 402 is dimensioned such that the first pin 386 of belt connector 380 is withdrawn from apertures 378 of drive rod 30 as the flange 390 traverses the camming plate 402.

The operation of the drive system 306-1 will now be described. As previously described, the drive system 306-1 is actuated based on the direction of rotation of the motor 302. For purposes of explanation, it is assumed that the motor 302 is rotated in the direction of arrow A such that drive system 306-1 is activated. Referring to FIGS. 7-10, when the motor 302 is rotated in the direction of arrow A, belt 348 is moved as shown by arrow M. Belt 348-1 of drive system 306-1 is always moved in direction M. As shown in FIGS. 7-10, the drive system 306-1 is positioned with the drive rod 370 and arms 374, 376 positioned midway between the stopper plates 362 and 364, although the drive rod 370 may be positioned at any point between the stopper plates 362, 364 when the motor 302 is actuated. The belt connector 380 connects drive rod 370 to run 349-1 of belt 348-1. When the motor 302 is actuated and belt 348-1 rotates in direction M, run 349-1 moves linearly in the direction of arrow F. The drive rod 370 is also extended linearly from the RET drive 300 in the direction of arrow F and the mechanical linkage 160-1, attached to the drive rod 370, is also extended linearly to thereby move the adjustable member of the phase shifter in a first direction. Specifically, as the belt 348-1 moves in the direction M, the engagement of the belt connector 380 with belt 348-1 and arm 374 of drive rod 370, transmits movement of belt 348-1 to the drive rod 370 and the associated mechanical linkage 160-1.

When the drive rod 370 reaches stopper plate 364, movement of drive rod 370 and its associated mechanical linkage 160-1 in direction F is stopped. It is noted that the system may be stopped at any position before this end stop position to position the drive rod 370 and associated mechanical linkage 160-1 at any intermediate position between the stopper plates 362, 364. The end stop positions are the fullest extended and retracted positions of the drive rod 370 and associated mechanical linkage 160-1. Specifically, the end stop positions occurs when stub 396 engages either stopper plate 364 or stopper plate 362 and prevents further extension or retraction, respectively, of the drive rod 370. When the stub engages stopper plate 362, the end stop position is the fullest retracted position of the drive rod 370 and associated mechanical linkage 160-1. When the stub engages stopper plate 364, the end stop position is the fullest extended position of the drive rod 370 and associated mechanical linkage 160-1. However, even though movement of the drive rod 370 is stopped, the belt 348 may continue to travel in the rotational direction of arrow M as explained below.

Figure 17:
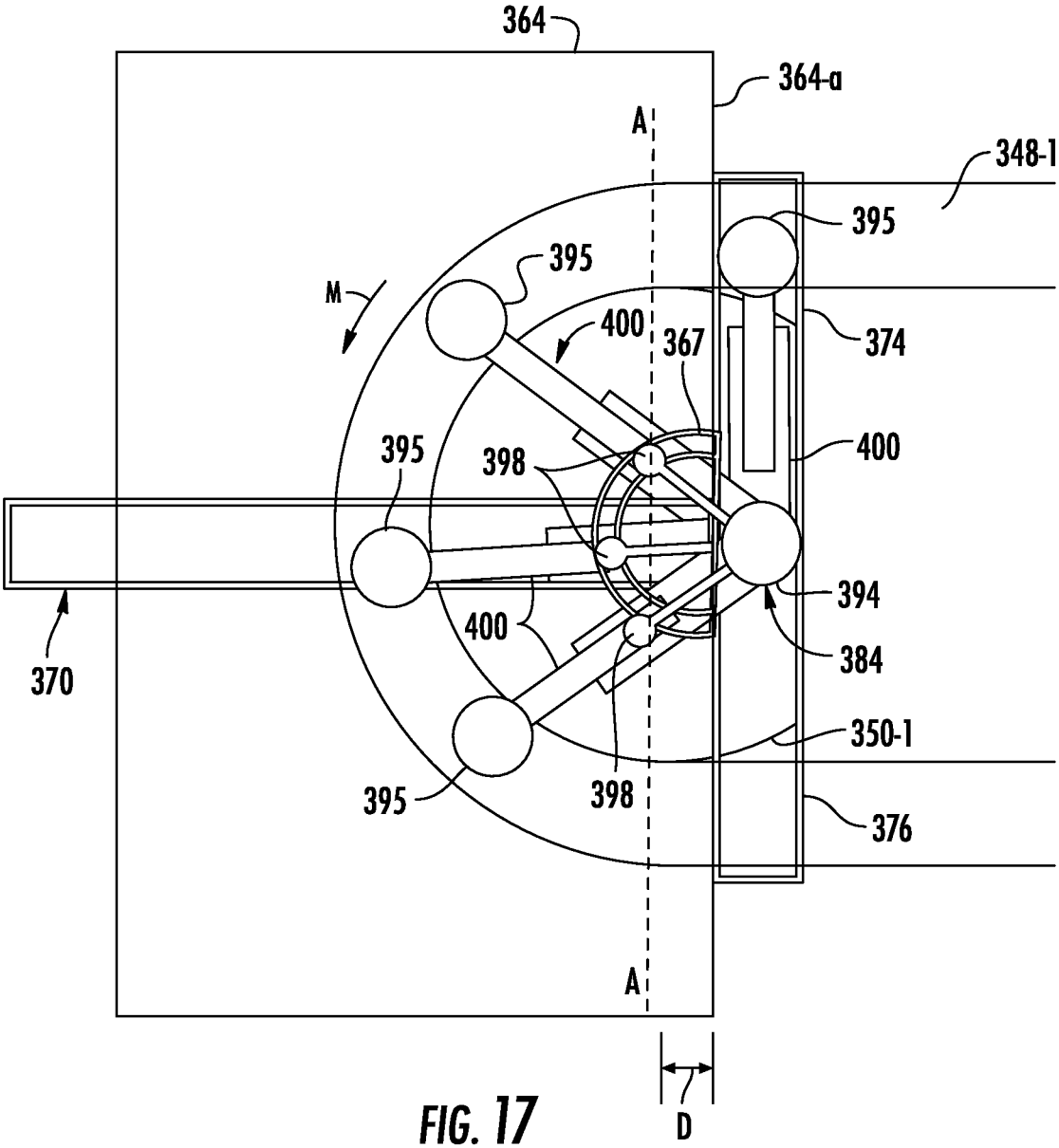
FIG. 17 is a schematic view illustrating the operation of the drive system of FIG. 7.

When the drive rod 370 reaches the extended end stop position, the cam pin 398 is positioned directly outside of the input end of track 367 in stopper plate 364. The cam pin 398 enters the track 367 as the belt 348-1 continues to move in the rotational direction M. As the belt 348-1 continues to move, the linkage connector 384 and cam pin 398 rotate about shaft 394. Referring more specifically to FIG. 17, the movement of the linkage connector 384 and cam pin 398 will be described. The center of track 367 is aligned with the axis of rotation of pulley 350-1 on plane A-A. The end 364*a* of stopper plate 364 is disposed offset from the axis of rotation of pulley 350-1 and the center of track 366 by distance D. Track 367 has a semicircular shape that follows the size and shape of the path of belt 348-1 about pulley 350-1. As belt 348 moves in direction M, cam pin 398 moves in track 366. Simultaneously, the end 395 of linkage arm 400 that is connected to the belt 348 follows the path of travel of belt 348 around pulley 350. As the end 395 of linkage arm 400 traverses the path about pulley 350, the linkage arm 400 rotates shaft 394 about its longitudinal axis to propel cam pin 398 in a circular arc through circular track 367.

Because the end 364*a* of the stopper plate 364 is positioned offset from the axis of rotation of pulley 350, the distance between the axis of rotation of shaft 394 and the end 395 of linkage arm 400 connected to belt 348-1 increases as the belt 348-1 winds around pulley 350-1. To accommodate this change in distance, the linkage arm 400 can extend and retract as previously described. As the cam pin 398 traverses the semi-circular track 367, the engagement of the cam pin 398 with the track 367 holds the linkage connector 384 in position against the stopper plate 364 and holds the drive rod 370 in the end position.

The cam pin 398 traverses track 367 until it reaches the opposite output end of track 367. Simultaneously, the belt connector 380 follows the path of the belt 348 as it winds about pulley 350. The end of pin 386 may be biased against the underside of stopper plate 364 by spring 393 as the belt connector 380 rotates about shaft 394. As the belt connector 380 follows the path of belt 348, the belt connector 380 reaches the front edge of the stopper plate 364 at the same time that the cam pin 384 reaches the output end of track 366. The belt connector 380 with pin 386 passes under arm 376 of the drive rod 370 where the pin 386 on belt connector 380 is inserted into the aperture 378 formed on the bottom of arm 376 under the bias force of spring 393. In this positon, the belt connector 380 connects the drive rod 370 to the belt 348-1 on the second run 347-1 of the belt 348-1. If the motor 302 continues to drive the belt 348 in the direction M, the belt 348-1 moves the drive rod 370 and the associated mechanical linkage 160-1 in the opposite linear direction E to retract the drive rod 370 and the associated mechanical linkage 160-1. The retracting movement of the drive rod 370 and associated mechanical linkage moves the movable element of the phase shift in the opposite direction to that of the extending movement of the drive rod.

The motor 302 can actuate belt 348 to move the drive rod 370 to any positon between the stopper plate 364 and the stopper plate 362 to thereby adjust the phase shifter to the desired position. When the drive rod 370 and associated mechanical linkage are properly positioned, the motor 302 is deactivated and the drive rod 370 is stopped in the desired position.

If it is necessary to extend the drive rod 370 to move the phase shifter in the opposite direction F, the motor 30 is again actuated to move the linkage system 360-1 into engagement with the stopper plate 362. The linkage system 360-1 reverses direction as previously described with respect to stopper plate 364 such that the connection between the drive rod 370 and the belt 348 is again made on the first run 349-1 of the belt 348. The motor 302 and belt 348 may be driven to position the drive rod 370 at any position along the first run 349-1 to extend the drive rod 370 and associated mechanical linkage 160-1 to any extended position.

Once the drive rod 370 and the associated mechanical linkage are properly positioned, the motor 302 is deactivated and movement of the belt 348 is halted. The worm gear 340-1 holds the system in the desired position to lock the movable element of the phase shifter in the selected position.

The motor may be rotated in direction A to adjust the first drive system 306-1 and its associated mechanical linkage as described. Alternatively, the motor 302 may be rotated in the opposite direction B to adjust the second drive system 306-2. Linkage system 360-2 operates in the same manner as linkage system 360-1 to move its drive rod and associated mechanical linkage 160-2 in either of two linear directions. Thus, a single, motor 302 may be used to selectively drive either one of the two drive systems 306-1, 306-2 in both linear directions (retracting and extending) simply by reversing the rotational direction of the motor 302.

The RET actuators according to embodiments of the present invention have various advantages over conventional RET actuators. The RET actuators use a single reversible motor to control movement of multiple phase shifters in two linear directions. The RET actuators may be very compact, and may have a low profile which allows them to readily be installed in a wide variety of different base station antennas.

The RET actuators according to embodiments of the present invention are suitable for use in base station antennas. The base station antennas may include any number of arrays of radiating elements (which can, but do not have to be, linear arrays of radiating elements), and the RET actuators may be used to control phase shifters that are associated with the arrays of radiating elements.

Figure 18:
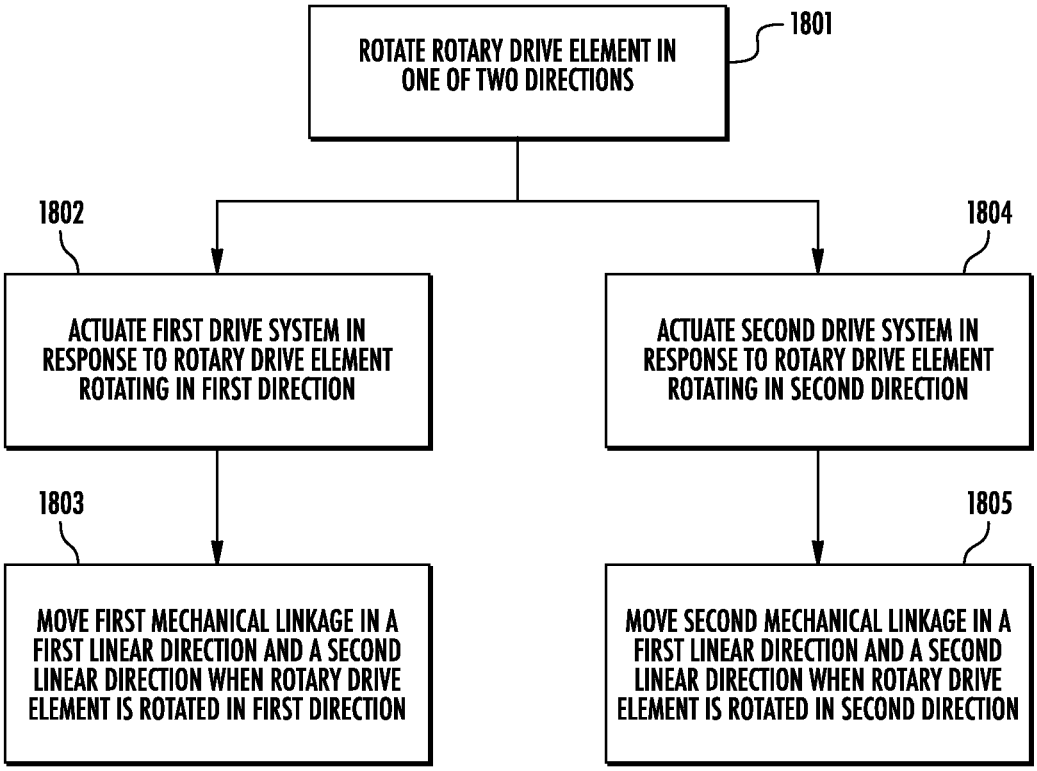
FIG. 18 is a block diagram illustrating a method of operating the RET actuator of FIG. 5.

Pursuant to further embodiments of the present invention, methods of adjusting a phase shifter of a base station antenna are provided. FIG. 18 is a flow chart that illustrates one such method according to embodiments of the present invention. As shown in FIG. 18. Operations of the RET actuator are initiated by rotating a rotary drive element in one of a first rotary direction and a second rotary direction (Block 1801). A first drive system, connected between the rotary drive element and a first mechanical linkage, is actuated in response the rotary drive element rotating in the first rotary direction (Block 1802). The first drive system moves the first mechanical linkage in a first linear direction and a second linear direction when the rotary drive element is moved in the first rotary direction (Block 1803). A second drive system, connected between the rotary drive element and a second mechanical linkage, is actuated in response the rotary drive element rotating in the second rotary direction (Block 1804). The second drive system moves the second mechanical linkage in a third linear direction and a fourth linear direction when the rotary drive element is moved in the second rotary direction (Block 1805).

The present invention has been described above with reference to the accompanying drawings. The invention is not limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Herein, the terms "attached", "connected", "interconnected", "contacting", "mounted" and the like can mean either direct or indirect attachment or contact between elements, unless stated otherwise.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, operations, elements, and/or components, but do not preclude the presence or addition of one or more other features, operations, elements, components, and/or groups thereof.

Components of the various embodiments of the present invention discussed above may be combined to provide additional embodiments. Thus, it will be appreciated that while a component or element may be discussed with reference to one embodiment by way of example above, that component or element may be added to any of the other embodiments.

The invention claimed is:

1. A base station antenna, comprising:

a remote electronic tilt ("RET") actuator;

a first mechanical linkage connected between the RET actuator and a first phase shifter, and a second mechanical linkage connected between the RET actuator and a second phase shifter, wherein the RET actuator comprises:

a rotary drive element movable in a first rotary direction and a second rotary direction;

a first drive system connected between the rotary drive element and the first mechanical linkage, the first drive system moving the first mechanical linkage in a first linear direction and a second linear direction when the rotary drive element is moved in the first rotary direction; and a second drive system connected between the rotary drive element and the second mechanical linkage, the second drive system moving the second mechanical linkage in a third linear direction and a fourth linear direction when the rotary drive element is moved in the second rotary direction.

2. The base station antenna according to claim 1, wherein the rotary drive element comprises a motor having a rotary output.

3. The base station antenna according to claim 1, wherein a first one-way clutch selectively connects the rotary drive element to the first drive system and a second one-way clutch selectively connects the rotary drive element to the second drive system.

4. The base station antenna according to claim 3, wherein the first one-way clutch and the second one-way clutch each comprise a cam gear supporting a pivoting pawl, the cam gear being operably coupled to the rotary drive element; and a ratchet wheel having a plurality of teeth operably coupled to a clutch output, the pawl engaging the teeth such that rotation of cam gear in a first direction causes the ratchet wheel to rotate with the cam gear and rotation of cam gear in a second direction allows the ratchet wheel to rotate independently of the cam gear.

5. The base station antenna according to claim 3 further comprising a first worm gear mounted for rotation with a clutch output of the first one-way clutch for transmitting rotation of the clutch output of the first one-way clutch to the first drive system and a second worm gear mounted for rotation with a clutch output of the second one-way clutch for transmitting rotation of the clutch output of the second one-way clutch to the second drive system.

6. The base station antenna according to claim 1, wherein the first drive system comprises a belt, wherein the belt is wound over a first pulley and a second pulley, wherein the belt includes a first run and a second run between the first pulley and the second pulley, wherein the first run moves in an extension direction and the second run moves in a retraction direction.

7. The base station antenna according to claim 6, wherein the first pulley and the second pulley include teeth that engage teeth on the belt.

8. The base station antenna according to claim 6, wherein the first run and the second run are selectively operably coupled to the first mechanical linkage by a first linkage system, wherein the first linkage system comprises a first stopper plate and a second stopper plate, and wherein the distance between the first stopper plate and the second stopper plate sets the maximum distance of travel of the first mechanical linkage.

9. The base station antenna according to claim 8, wherein the first stopper plate is positioned adjacent the first pulley and the second stopper plate is positioned adjacent the second pulley.

10. The base station antenna according to claim 8, the first stopper plate comprises a first curved track and the second stopper plate comprises a second curved track, wherein the first curved track faces the second curved track.

11. The base station antenna according to claim 10, wherein at least one of the first stopper plate and the second stopper plate comprises a longitudinally extending track, and further comprising a drive rod mounted for reciprocating movement, the drive rod being operatively coupled to the first mechanical linkage, wherein the drive rod is mounted for slidable movement in the longitudinally extending track.

12. The base station antenna according to claim 11, wherein the drive rod has a generally T-shape with the longitudinal leg of the drive rod supported in the longitudinally extending track.

13. The base station antenna according to claim 11, wherein the drive rod comprises a first arm and a second arm, the first arm extending over the first run and the second arm extending over the second run, and further comprising a belt connector for releasably connecting the drive rod to the first run of the belt and to the second run of the belt, wherein the first arm includes a first engagement structure positioned to engage a belt connector that is mounted on and carried by the belt, and wherein the second arm includes a second engagement structure positioned to engage the belt connector, wherein the first engagement structure comprises a first aperture positioned to receive a pin on the belt connector and the second engagement structure comprises a second aperture positioned to receive the pin.

14. The base station antenna according to claim 13, wherein the belt connector is biased toward the drive rod.

15. The base station antenna according to claim 14, wherein a first camming plate is positioned at the leading edge of the first stopper plate and a second camming plate is positioned at the leading edge of the second stopper plate, wherein the first camming plate and the second camming plate drive the belt connector away from the drive rod, and wherein the first camming plate disengages the first engagement structure from the connector and the second camming plate disengages the second engagement structure from the connector.

16. The base station antenna according to claim 11, further comprising a linkage connector rotatably mounted to the drive rod about a rotational axis, wherein the linkage connector comprises a stub, and wherein the stub is aligned with the rotational axis of the linkage connector.

17. The base station antenna according to claim 16, wherein the stub engages the first stopper plate and the second stopper plate to set a first stop position and a second stop position of the first mechanical linkage, and wherein the linkage connector comprises a shaft aligned with the rotational axis of the linkage connector.

18. The base station antenna according to claim 17, further comprising a linkage arm connected between the shaft and the belt, wherein the linkage arm is extensible and retractable between the shaft and the belt.

19. The base station antenna according to claim 18, wherein the linkage connector comprises a cam pin, wherein the cam pin is disposed such that the cam pin can enter and traverse the first curved track and the second curved track.

20. The base station antenna according to claim 19, wherein when one of the first stop position and the second stop position is reached, the belt is free to travel.

21. The base station antenna according to claim 20, wherein when the drive rod reaches the first stop position and the second stop position, the cam pin is positioned directly outside of one end of the first track and the second track, respectively.

22. The base station antenna according to claim 21, wherein when the drive rod reaches the first stop position and the second stop position, the cam pin traverses the first track and the second track, respectively, as the belt travels.

23. The base station antenna according to claim 21, wherein when the drive rod reaches the first stop position and the second stop position, the linkage connector and cam pin rotate about the shaft.

24. The base station antenna according to claim 21, wherein when the drive rod reaches the first stop position and the second stop position, the linkage arm follows the path of travel of belt and rotates the shaft about its longitudinal axis to propel the cam pin through the first track and the second track, respectively.

25. The base station antenna according to claim 21, wherein when the drive rod reaches the first stop position and the second stop position and the cam pin traverses the first track and the second track, respectively, the belt connector follows the path of the belt.

26. The base station antenna according to claim 21, wherein when the drive rod reaches the first stop position and the second stop position and the cam pin reaches an end of the first track and the second track, respectively, the belt connector connects the drive rod to the belt.

27. A RET actuator comprising:

a rotary drive element movable in a first rotary direction and a second rotary direction;

a first drive system having a first linear output connected to the rotary drive element, the first drive system moving the first linear output in a first linear direction and a second linear direction when the rotary drive element is moved in the first rotary direction; and a second drive system having a second linear output connected to the rotary drive element, the second drive system moving the second linear output in a third linear direction and a fourth linear direction when the rotary drive element is moved in the second rotary direction.

28. A method of adjusting a phase shifter of a base station antenna comprising a remote electronic tilt ("RET") actuator, a plurality of phase shifters, a first mechanical linkage connected between the RET actuator and a first phase shifter, and a second mechanical linkage connected between the RET actuator and a second phase shifter, the method comprising:

rotating a rotary drive element in one of a first rotary direction and a second rotary direction;

actuating a first drive system connected between the rotary drive element and the first mechanical linkage in response the rotary drive element rotating in the first rotary direction, the first drive system moving the first mechanical linkage in a first linear direction and a second linear direction when the rotary drive element is moved in the first rotary direction; and actuating a second drive system connected between the rotary drive element and the second mechanical linkage in response the rotary drive element rotating in the second rotary direction, the second drive system moving the second mechanical linkage in a third linear direction and a fourth linear direction when the rotary drive element is moved in the second rotary direction.

* * * * *